US008332969B2

(12) United States Patent
Spadola et al.

(10) Patent No.: US 8,332,969 B2
(45) Date of Patent: Dec. 18, 2012

(54) AUTOMATIC CONTROL AND BATTERY POWER SUPPLY

(76) Inventors: Joseph Spadola, Ridgefield, NJ (US); Joseph Damianoe, Glen Rock, NJ (US); John Orris, Norwalk, CT (US); Brian Bernberg, Hoboken, NJ (US); Vladmir Yakhnich, Westwood, NJ (US)

( * ) Notice: Subject to any disclaimer, the term of this patent is extended or adjusted under 35 U.S.C. 154(b) by 940 days.

(21) Appl. No.: 12/359,582

(22) Filed: Jan. 26, 2009

(65) Prior Publication Data

US 2009/0235441 A1 Sep. 24, 2009

Related U.S. Application Data

(63) Continuation-in-part of application No. 11/539,967, filed on Oct. 10, 2006, now Pat. No. 7,823,227.

(60) Provisional application No. 61/023,743, filed on Jan. 25, 2008.

(51) Int. Cl.
*E03D 9/02* (2006.01)

(52) U.S. Cl. ..... 4/227.1

(58) Field of Classification Search ..... 4/246.1, 4/227.1, 234

See application file for complete search history.

(56) References Cited

U.S. PATENT DOCUMENTS

| | | | | |
|---|---|---|---|---|
| 3,335,431 | A | 8/1967 | Coates | |
| 3,366,979 | A | 2/1968 | Johnston | |
| 3,781,923 | A | 1/1974 | Maisch et al. | |
| 3,805,304 | A | 4/1974 | Ikehata | |
| 4,044,408 | A | 8/1977 | Pearson | |
| 4,472,841 | A * | 9/1984 | Faulkner | 4/213 |
| 4,841,583 | A | 6/1989 | Ohara et al. | |
| 4,944,045 | A | 7/1990 | Agelatos et al. | |
| 5,353,443 | A | 10/1994 | Sim | |
| 5,551,095 | A * | 9/1996 | Chen | 4/227.3 |
| 5,829,066 | A | 11/1998 | Aibe | |
| 6,052,837 | A | 4/2000 | Norton | |
| 6,260,214 | B1 * | 7/2001 | Smith | 4/213 |
| 2005/0028254 | A1 * | 2/2005 | Whiting | 4/213 |
| 2005/0273917 | A1 * | 12/2005 | Lapossy | 4/213 |
| 2006/0037126 | A1 * | 2/2006 | Hippensteel | 4/213 |
| 2006/0288469 | A1 * | 12/2006 | Gan | 4/213 |
| 2008/0000017 | A1 * | 1/2008 | Littrell et al. | 4/213 |

FOREIGN PATENT DOCUMENTS

| | | |
|---|---|---|
| WO | WO2007049975 | 5/2007 |

* cited by examiner

*Primary Examiner* — Gregory Huson
*Assistant Examiner* — Karen L Younkins
(74) *Attorney, Agent, or Firm* — Michael A. Blake

(57) ABSTRACT

An automatic control and battery power supply for a bathroom odor removal unit. The power supply comprising: a housing, the housing comprising: a top face in generally orthogonal communication with a toilet tank face; a toilet tank face in generally orthogonal communication with a bottom face; a sensor face in communication with the top face, and the toilet tank face, and where the angle between the sensor face and the toilet tank face is obtuse; a hanger connectable to the housing, and configured to hang from the upper edge of a toilet tank with the housing outside of and generally to one side of the toilet tank; a sensor located on the sensor face.

11 Claims, 24 Drawing Sheets

AUTOMATIC CONTROL AND BATTERY POWER SUPPLY

CROSS-REFERENCES

This patent application claims the benefit of provisional patent application Ser. No. 61/023,743 by Joseph Spadola, et al., entitled "Automatic Control and Battery Power Supply" filed on Jan. 25, 2008, the entire contents of which are fully incorporated by reference herein. This patent application is also a continuation-in-part of a U.S. patent application Ser. No. 11/539,967 filed on Oct. 10, 2006 now U.S. Pat. No. 7,823,227 by Joseph Damianoe, et al., entitled "Bathroom Odor Removal Apparatus and System", the entire contents of which are fully incorporated by reference herein.

TECHNICAL FIELD

The disclosures made herein relate generally to odor control apparatuses and systems and, more particularly, to a controller and power supply for bathroom odor control apparatuses.

BACKGROUND

By nature, unpleasant odors are generated in a toilet bowl and have no other way out other than through the top of the toilet bowl due to its gaseous nature. Accordingly, such unpleasant odors adversely impact the air surrounding the toilet and, ultimately, the overall air quality of a bathroom in which the toilet is located. Conventional approaches for controlling odors in bathrooms include scented aerosol dispensers, scented tablets, room ventilation systems and the like.

Such conventional approaches for controlling odors in bathrooms are known to have limitations that adversely affect their effectiveness and/or practicality. One limitation is that unpleasant odors that originate in an area of a particular toilet bowl are allowed to migrate into or are drawn into other areas of a bathroom, thus adversely impacting the overall air quality of the bathroom. Another limitation is that some people dislike or are allergic to perfumed scents of aerosol sprays and tablets commonly used to cover-up unpleasant odors in bathrooms. Still another limitation is that some bathrooms are not physically situated or constructed in a manner where a window or fan can be provided for facilitating ventilation of such bathrooms. Many bathrooms are equipped with a ceiling vent that is meant to draw odors out of the bathroom. However, this solution for controlling odor is frequently inadequate because very large volumes of room air must be exhausted in order to dissipate odors that are actually concentrated in and about the toilet bowl.

Some known toilet bowl odor removing systems require that the system be attached to a wall mounted electrical outlet, which may be undesirable. For instance, a wall outlet may not be conveniently located near the toilet bowl; many people find a power cord, running through their bathroom, aesthetically displeasing; many people feel that a power cord, connected to a wall power outlet and attached to a water filled appliance, is dangerous; it is expensive and difficult to add a 120 Volt power outlet at the toilet location, especially if the walls are covered with ceramic tile or marble etc; parents of small children may be concerned that the children may pull on the power cord thus creating a dangerous situation and possibly damaging the attached apparatus. Some known toilet bowl odor removing systems have fans which make noise. Many people do not want the noise to be present at all times. Thus there is a need to limit the time the fan runs to reduce the amount of noise produced by the fan.

Therefore, an automatic control and battery power supply that overcomes the above listed and other disadvantages associated with bathroom odor control devices would be desirable.

SUMMARY

The disclosed invention relates to an automatic control and battery power supply for a bathroom odor removal unit, the automatic control and battery power supply comprising: a housing, the housing comprising: a top face in generally orthogonal communication with a toilet tank face; a toilet tank face in generally orthogonal communication with a bottom face; an away face in generally orthogonal communication with the bottom face and top face; a back face in generally orthogonal communication with the toilet tank face, top face and away face; a front face in generally orthogonal communication with the toilet tank face, top face, and away face; a bottom face in generally orthogonal communication with the back face; front face, toilet tank face, and away face; a sensor face in communication with the front face, top face, bottom face, and toilet tank face, and where the angle between the sensor face and the toilet tank face is obtuse; a hanger connectable to the housing, and configured to hang from the upper edge of a toilet tank with the housing outside of and generally to one side of the toilet tank; a power supply located within the housing; a controller located within the housing, and in communication with the power supply; a sensor located on the sensor face, and in signal communication with the controller; at least one display light located on the sensor face, and in signal communication with the controller; a user input device located on the sensor face, and in signal communication with the controller; a plug attached to the housing, and in signal communication with the controller.

The disclosed invention also relates to a bathroom odor removal system comprising: a toilet tank; an odor removal unit installed in the tank, wherein the odor removal unit does not have a controller or a power supply located within the odor removal unit; an automatic control and battery power supply in signal communication with the odor removal unit, and hanging from the side of the toilet tank, the automatic control and battery power supply comprising: a housing, the housing comprising: a top face in generally orthogonal communication with a toilet tank face; a toilet tank face in generally orthogonal communication with a bottom face; an away face in generally orthogonal communication with the bottom face and top face; a back face in generally orthogonal communication with the toilet tank face, top face and away face; a front face in generally orthogonal communication with the toilet tank face, top face, and away face; a bottom face in generally orthogonal communication with the back face; front face, toilet tank face, and away face; a sensor face in communication with the front face, top face, bottom face, and toilet tank face, and wherein the angle between the sensor face and the toilet tank face is obtuse; a hanger attached to the housing, and hanging from the upper edge of a toilet tank with the housing outside of and generally to one side of the toilet tank; a power supply located within the housing; a controller located within the housing, and in communication with the power supply; a sensor located on the sensor face, and in signal communication with the controller; at least one display light located on the sensor face, and in signal communication with the controller; a user input device located on the sensor face, and in signal communication with the controller; a plug attached to the housing, and in signal communication with the controller and in signal communication with the odor removal unit.

In addition, the invention relates to a bathroom odor removal system comprising: a toilet tank, with a front face, and a at least one small opening located above the water level in the front face; an odor removal unit installed in the tank, wherein the odor removal unit does not have a controller or a power supply located within the odor removal unit; an automatic control and battery power supply in signal communication with the odor removal unit, and installed in the tank also, the automatic control and battery power supply comprising: a housing; a power supply located within the housing; a controller located within the housing, and in communication with the power supply; a sensor located on the housing, and in signal communication with the controller, the sensor generally aligned with the at least one small opening and a space where a person would sit while using the toilet and where a person would stand while using the toilet; at least one display light located on the housing, and in signal communication with the controller, the at least one display light generally aligned with the at least one small opening, such that a user would be able to see the display light from outside of the tank; a user input device located on the housing, and in signal communication with the controller; and a plug attached to the housing, and in signal communication with the controller and in signal communication with the odor removal unit.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
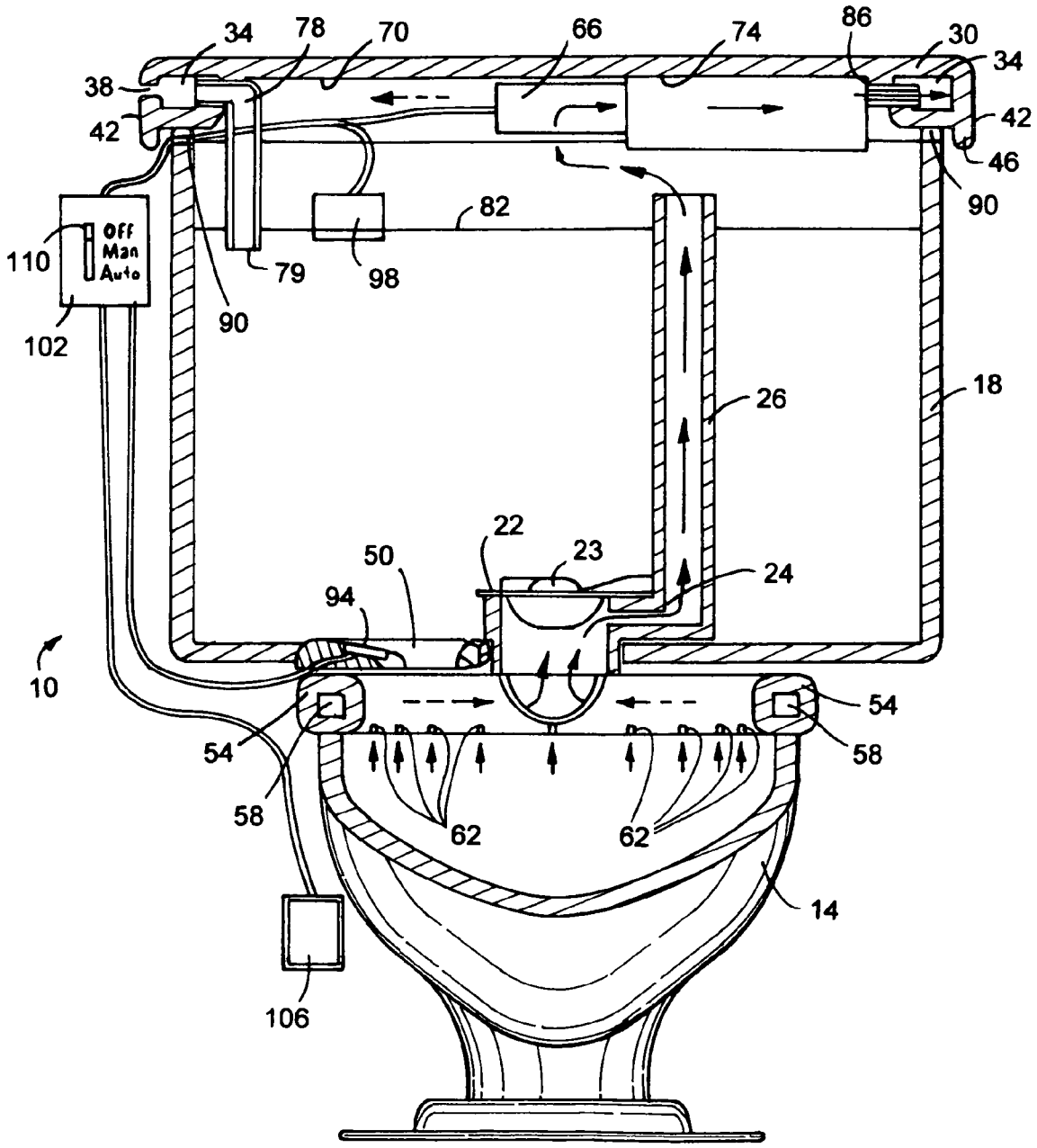
FIG. 1 is a schematic diagram of the disclosed bathroom odor removal system.

FIG. 1 is a schematic diagram of a bathroom odor removal system 10. A toilet bowl 14 is in fluid communication with a toilet tank 18. A toilet flush valve 22 is located between the toilet bowl 14 and toilet tank 18. An overflow pipe 26 is in fluid communication with the toilet flush valve 22. A toilet tank lid 30 covers the toilet tank 18. Known prior art toilet tank lids 30 typically have a lid conduit 34 that runs within the lid 30, often around a periphery of the lid 30. Standard lids 30 can be modified for use in the disclosed invention by making three to twenty lid air openings 38. The openings 38 may be plurality of holes, preferably between 2 and 7 holes of various sizes, through the outer surface 42 of the lid lip 46 so that the air outside of the tank 18 will be in fluid communication with the air inside the conduit 34. If the lid is made out of vitreous china, the holes may be drilled using diamond drills. In other embodiments, the lids 30 may be manufactured specifically for use with the system, with the lid air openings 38 already located in the lid 30. Attached to the toilet bowl 14 is the toilet seat 50 (only shown partially for simplification). The toilet bowl 14 comprises a toilet bowl rim 54. The toilet bowl rim 54 has a fluid channel 58 that is in communication with flush valve 22. Located generally along a periphery of the toilet bowl rim 54 are flush water holes 62. The flush valve comprises a flapper 23 and an overflow pipe conduit 24 to the overflow pipe 26. As typical with most toilets, water can flow into the toilet bowl via two paths, the first path is through the flapper 23, then to the fluid channel 58, then through the flush holes 62 into the toilet bowl 14. The second path is through the overflow pipe 26, through the overflow pipe conduit 24, then into the fluid channel 58, then through the flush holes 62 into the toilet bowl 14. Water is supplied to the tank and to the overflow pipe 26 from a refill valve (not shown) that supplies fresh water to the toilet. Located within the tank 18 is an air filter 74 housing. The air filter housing 74 may house any suitable filtering means for generally removing bathroom odors, such as but not limited to an activated carbon media. In one embodiment, the air filter housing 74 may be attached to the lower surface 70 of the tank lid 30. Also located within the tank 18 is a blower fan 66. The blower fan 66 may be capable of moving about 1 to about 2 CFM given the static pressure of the system. The blower fan 66 may be adjustable to compensate for special conditions and system losses, air flow resistance, and sound level and performance. In one embodiment, the blower fan may be attached to the air filter 74. An exhaust tube 86 is in fluid communication with the filtering means and the lid conduit 34 in the lid 30. A make up air tube 78 is attached to the lid 30 and is in fluid communication with the lid air openings 38. When the tank 18 is full, the water level is at the water level line 82. There is also a seal 90 located between the tank 18 and lid 30. The seal extends about the perimeter of the top of the tank 18, and creates a generally airtight seal between the tank lid 30 and tank 18. Standard tanks and lids are expected to leak air and are part of the venting of a toilet. Thus the task of sealing the surfaces between the tank 18 and the lid 30 is important. Material for the seal 90 may be any suitable resilient seal material or materials. One suitable sealing means, includes, but is not limited to: a combination of Frost King, Poly Foam, #L342, applied to the lid 30 in combination with Frost King, Poly Foam, # L341 applied to the tank 18. Additionally, there is a flush sensor 98 located in the tank 18. The flush sensor 98 is configured to detect a drop in water level in the tank 18. The flush sensor 98 is in communication with the blower fan 66. When a flush is detected, i.e. the water level drops in the tank 18, the flush sensor sends a signal to the blower fan 66. Upon receipt of the signal, the blower fan 66 shuts off for a predetermined time to allow the flush to complete. This is necessary because the blower fan 66 and the seal 90 creates a negative pressure in the tank 18. This negative pressure may prevent and/or retard the water from exiting the tank 18 and entering the toilet bowl 14. The make up air tube 78 allows for air to enter the tank 18 when a flush occurs. The make up air tube 78 is normally sealed because the water level line 82 is above the make air tube 78 outlet 79. As soon as the water level line goes below the inlet 79 of the make up air tube 78, the make up air tube 78 is unsealed, and air can enter the tank 18. The outlet 79 is configured to be about ½ inch to about 1½ inches below the water level of the toilet tank when the toilet tank is full.

In operation, the bathroom odor removal system, works as follows. A person sits on the toilet seat 50, creating a generally enclosed space in the interior of the toilet bowl 14. The blower fan 66 creates a negative pressure in the interior of the tank 18, in the air space generally above the water level line 82. The negative pressures causes air to be pulled from the interior of the bowl 14, through the flush water holes 62, into the fluid channel in the toilet bowl rim 54, to the flush valve 26, through the overflow pipe conduit 24, and up through the overflow pipe 26. The blower fan 66 directs the air so that it travels through the filtering means in the air filter housing 74 where odors are generally removed from the air. The cleaned air leaves the filtering means and enters the one to five exhaust tubes 86, where it enters the lid conduit 34 in the lid 30 and exits via the lid air openings 38, thereby exiting the system and entering the bathroom or other room where the toilet is located. The arrows show generally the pathway of the air through the system 10. In one embodiment the blower fan 66 may be in continuous operation. In an other embodiment, the blower fan may be turned on and off manually by the user. In still another embodiment, the blower fan 66 may be automatically turned on and off based on sensor inputs. This automatically operated blower fan embodiment will be discussed further below.

Still referring to FIG. 1, the bathroom odor removal system 10 may be configured to automatically activate the blower fan 66 when a user sits on the toilet seat 50. A human proximity sensor 94 may be located on the toilet seat 50. The human proximity sensor 94 will be configured to detect when a person sits on the toilet seat 50. The human proximity sensor 94 may be a capacitive sensor. One such sensor is the TS100 TOUCHCELL made by TouchSensor Technologies, LLC, 203 North Gables Boulevard, Wheaton, Ill. 60187. A controller 102 is in communication with the human proximity sensor 94, blower fan 66, and flush sensor 98. The controller 102 may have a Programmable Logic unit or CPU. When the human proximity sensor 94 detects a person sitting on the toilet seat 50, a signal is sent to the controller 102, whereby the controller activates the blower fan 66, and the blower fan begins creating a negative pressure in the toilet tank 18. When the human proximity sensor 94 detects that the person has left the toilet seat 50, a signal is sent to the controller 102, whereupon the controller turns off the blower fan 66. In addition, when a drop in water level is detected by the flush sensor 98, a signal is sent to the controller 102. The controller can then stop the blower fan 66 from operating for a set amount of time, to allow the flush action to complete. The blower fan 66, controller 102, sensor 94, and flush sensor 98 may all be in communication with a power supply 106. The power supply may be external to the toilet, e.g. an electrical outlet, or may be internal to the system, e.g. batteries in the controller 102.

The controller 102 may have an external switch 110. The switch may allow a user to select "Off", "Manual On", and "On Automatic." When turned Off, the system will shut down manually. When turned to Manual On, the blower fan 66 activates. When turned to On Automatic, the blower fan activates when a person sits on the toilet seat 50 and activates the human proximity sensor 94. When the person leaves the toilet seat 50, the human proximity sensor notifies the controller 102, which in turn shuts off the blower fan 66, immediately, or after a pre-set period of time, to allow for any slight residual odor to be removed.

Figure 2:
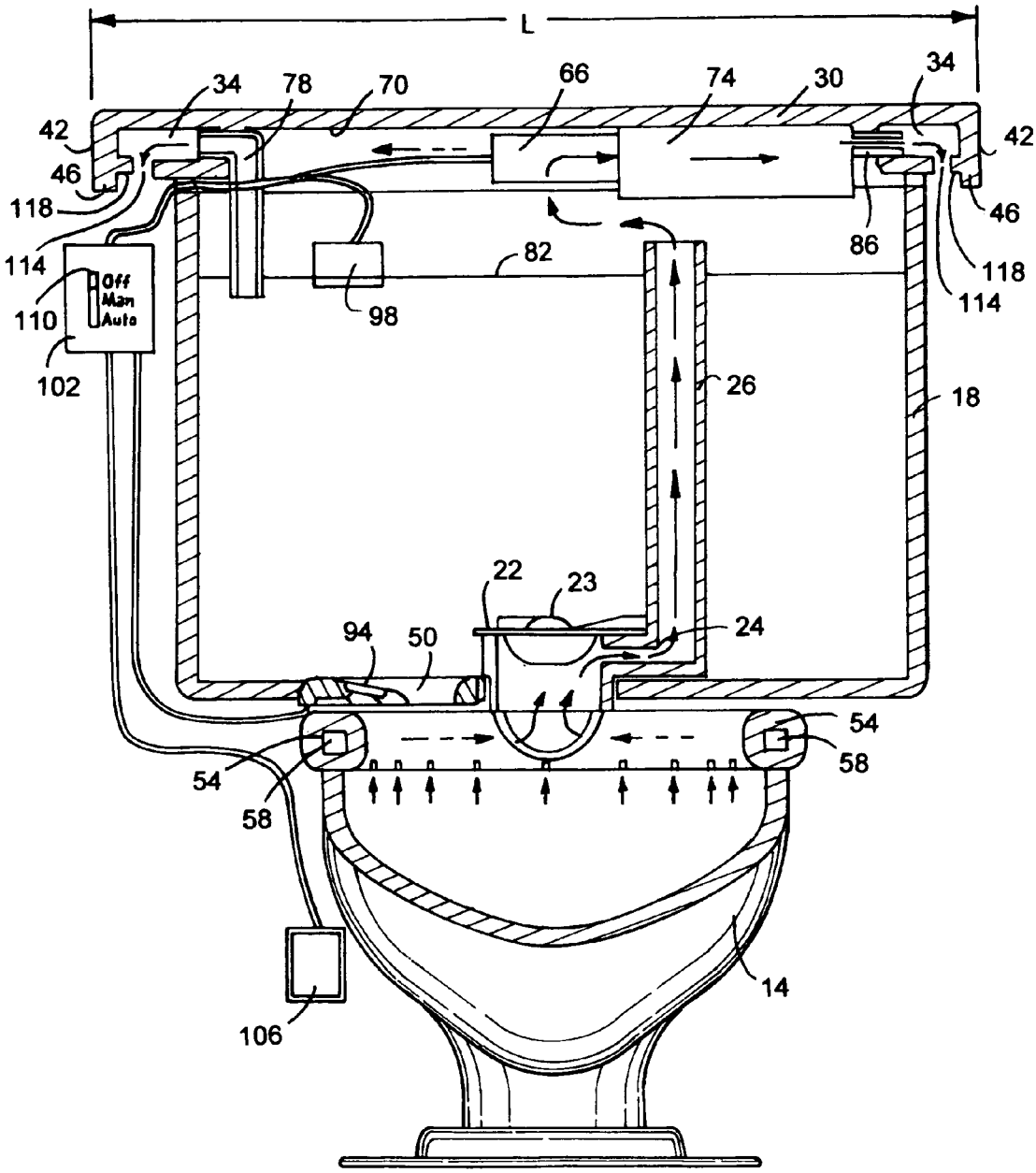
FIG. 2 is a schematic diagram of the disclosed bathroom odor removal system with slots in the toilet tank lid rather than holes.

In other embodiments, where physical layout and construction permit, instead of the lid air openings 38 being located through the outer surface 42 of the lid lip 46, air slots 114 may be made along the underside 118 of the lid 30, as shown in FIG. 2. The air slots 114 may travel transverse to the length L of the lid (i.e. along the width of the lid). The air slots 114 allow fluid communication between the lid conduit 34 and the outside of the tank 18. These air slots 114 would normally be unseen since they are located on the bottom surface 118 of the lid 30, and thereby provided a more aesthetically pleasing appearance.

Figure 3:
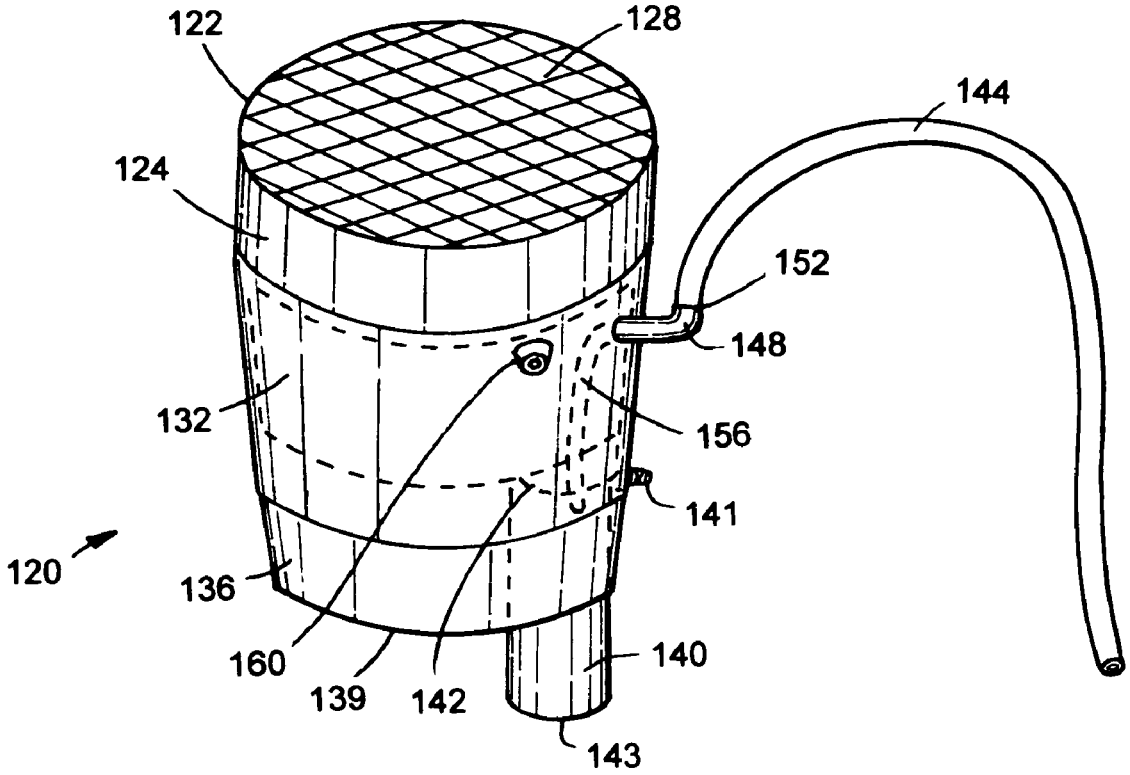
FIG. 3 is perspective view of the disclosed bathroom odor removal apparatus.

FIG. 3 shows another embodiment of the disclosed invention. In this embodiment, the bathroom odor removal system is an odor removal unit 120. The odor removal unit 120 comprises a housing 122. Within the housing is an air filter 124. The housing 122 may have a mesh top 128 adjacent to the air filter 124. Also adjacent to the air filter 124 is a blower fan 132. A water skirt 136 extends from the housing 122. The water skirt 136 is open at its bottom end 137. Extending from the water skirt 136 is a stabilizer tube 140. The stabilizer tube 140 is open at both ends, its inlet end 142 and its outlet end 143 A refill tube 144 connects to the housing 122 via an adapter 148. The adapter 148 is configured so that the refill tube 144 attaches to the adapter 148 on the adapter's upper side 152. The adapter 148 attaches to an inner conduit 156. The inner conduit 156 leads to the stabilizer tube 140, such that any fluid exiting the inner conduit 156 enters the stabilizer tube 140. A power connector 160 allows for the external supply of power to the blower fan 132. However, in other embodiments, the housing 122 may house a power supply such as a battery, or a battery pack. In still other embodiments, a power supply may be adjacent to the odor removal unit 120. A locking screw 141 is configured to screw into the housing 122 and through the stabilizer tube 140. The locking screw 141 is further configured to lock onto the overflow pipe 26, when the stabilizer tube 140 is connected to the overflow pipe 26.

Figure 4:
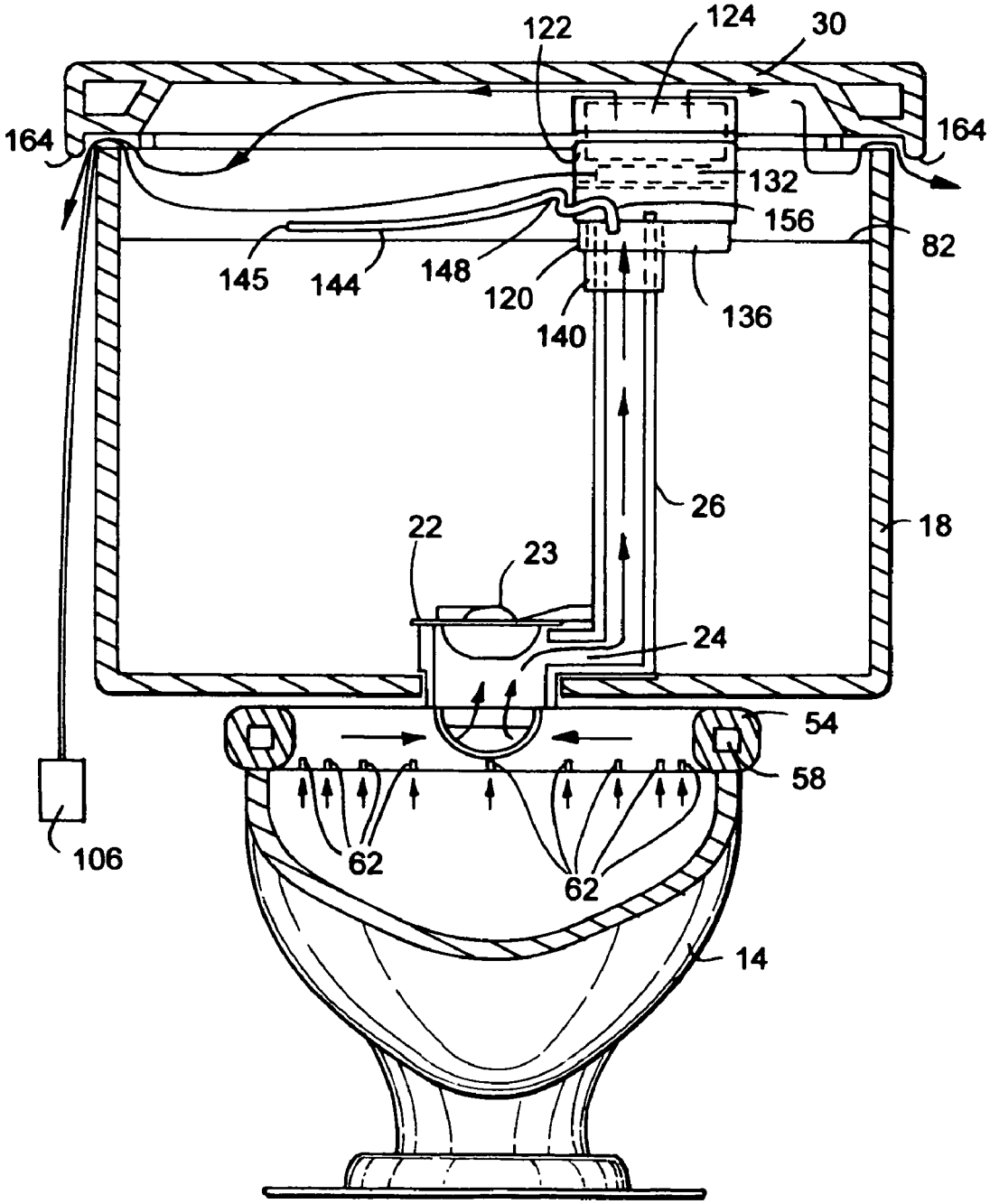
FIG. 4 is a schematic diagram of the disclosed bathroom odor removal apparatus installed in a toilet.

FIG. 4 shows the odor removal unit 120 installed in a toilet tank 18. The stabilizer tube 140 slides over the overflow pipe 26. The refill tube 144 is shown attached to the adapter 148. The free end 145 of the refill tube 144 is not shown connected to the tank fill valve. The tank fill valve is not shown in order to simplify the Figure. However, one of ordinary skill will easily understand that the refill tube 144 connects to the tank fill valve, and provides refill water to the bowl 14 via the inner conduit, and down the overflow pipe. The connection of the refill tube 144 to the refill valve is well known by those of ordinary skill in the art. A power supply 106 is shown external to the toilet and in communication with the odor removal unit 120. However, in other embodiments the external power supply 106 may be replaced by one or more batteries located external to the unit 120. There are no seals in this embodiment between the tank 18 and the tank lid 30. Thus air can leave the tank and enter the tank via gaps 164 between the lid 30 and tank 18. The arrows show the possible pathways of air from the toilet bowl 14, through the flush water holes 62, into the fluid channels 58, into the toilet flush valve 22, through the overflow pipe conduit 24, up the overflow pipe 26, through the stabilizer tube 140, through the blower 132, through the air filter 124, out through the gaps 164, and back to the atmosphere.

The water skirt 136 is configured such that when the tank 18 is full of water, the water covers a portion of the bottom of the water skirt 136 thus forming a sealed chamber within the water skirt 136. This sealed chamber is in fluid communication with the overflow pipe 26 and the inlet side blower fan 132. The blower fan 132 creates a slight negative pressure above the overflow pipe and, as previously discussed, air is drawn in from the bowl 14, up through the flush water holes 62, into the fluid channels 58, into the toilet flush valve 22, through the overflow pipe conduit 24, up the overflow pipe 30, through the stabilizer tube 140, through the blower 132, through the air filter 124, out through the gaps 164, and back to the atmosphere. The water level line 82 shows where the water level is when the tank 18 is full. During a flush, the water level drops below the water skirt 136, and there is no longer a negative pressure within the water skirt 136, because there is no longer a sealed chamber, due to the water level having lowered, and thus "unsealing" the chamber within the water skirt 136.

Given the differential pressure between the bowl area 14, at atmospheric pressure, and the space in the water skirt 136 chamber and the physical airway between them the foul vapors are effectively drawn from the bowl 14 to the supply side of the blower fan 132. From there the foul air is sent through the filter media 124, cleaned, and released back to the space above the water where a slight positive pressure, due to the output of the filter, pushes the cleaned air out through the gaps 164 between the tank 18 and lid 30 to the atmosphere. During a flush and until the water again rises to the water level line, and covers the bottom of the water skirt 136, the overflow pipe 26 is effectively open to the atmosphere and can function as a vent to allow the water to empty out of the bowl 14, after the flush valve has closed.

In other embodiments, rather than using a stabilizer tube 140, the odor removal unit 120 may be attached to a stand, with supporting legs, which is placed in the tank 18, and configured to hold the unit 120 at the proper height so that when the water level is at the water level line 82, a chamber is formed within the water skirt 136, thus allowing for air from the bowl 14 to be drawn up due to the negative pressure in the chamber created by the blower fan 132.

Figure 5:
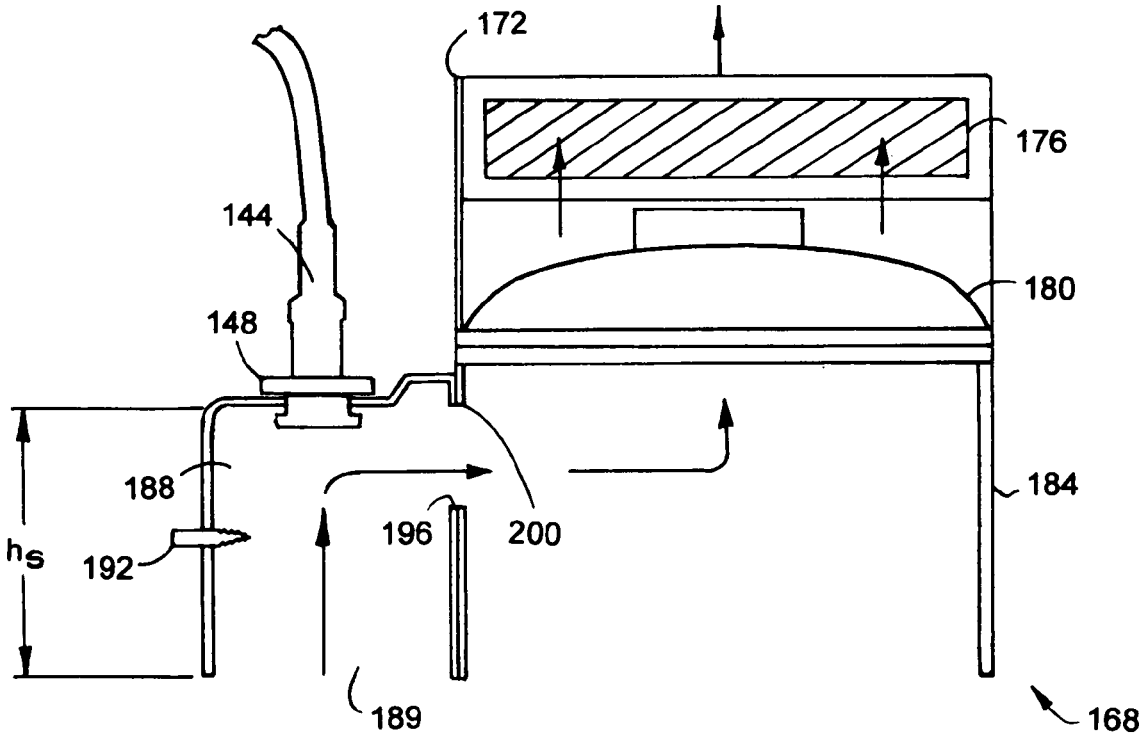
FIG. 5 is cross-sectional view of another embodiment of the disclosed bathroom odor removal apparatus.

FIG. 5 shows a cross-sectional view another embodiment of an odor removal unit 168. In this unit, a housing 172 encloses a filter 176 and a blower fan 180. The housing extends into a water skirt 184 which is open at the bottom. Removeably attached to the water skirt 184 is a standard stabilizer adaptor unit 188 that is configured to slide over an overflow pipe 26. The stabilizer adaptor unit is open on only one end, its outlet end 189. A locking screw 192 is configured to lock the stabilizer adaptor unit onto the overflow pipe 26. The stabilizer adaptor unit 188 has an opening 196 that is adjacent to an opening 200 in the water skirt 184. These openings allow air from the overflow pipe 26 to enter the standard stabilizer adaptor unit 188, exit the stabilizer adaptor unit 188 via the opening 196, and enter the water skirt 184 via the opening 200. The arrows indicate possible pathways that the air may take. When the water level is above the bottom of the standard stabilizer adaptor unit 188 and the water skirt 184, the water skirt 184 and standard stabilizer adaptor unit 188 forms a low pressure chamber that pulls air up from the overflow pipe, into the blower fan 180 and on into the filter 176 where it exits the odor removal unit 168.

Figure 6:
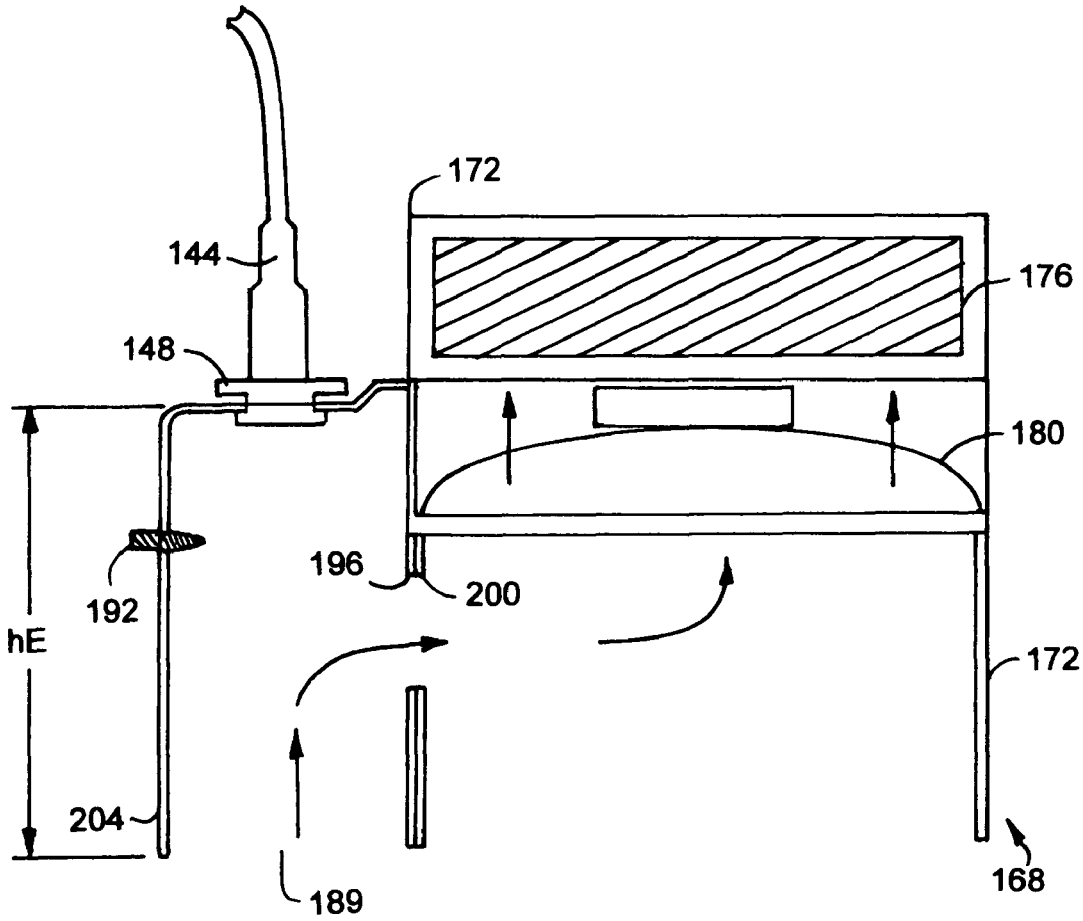
FIG. 6 is cross-sectional view of the disclosed bathroom odor removal apparatus from FIG. 5 with an extended stabilizer tube installed.

The stabilizer adaptor unit is designed as a separate unit, which attaches to the water skirt, primarily for the purpose of making the entire assembly very adaptable to a wide variety of installations. For instance, the overflow pipe, in any individual situation, may be found to be rotated about the flapper valve to any position that clears the flush handle rod. Although possible it is very difficult to change the position that the overflow pipe is found therefore it is desirable to leave the overflow pipe in the found position and adapt the air sanitizing unit attachment to accommodate it. As the overflow pipe is rotated, to different positions, the spatial relationships, within the tank can change such that the mounting requirements of the air sanitizing unit also change The standard stabilizer adaptor unit 188 has a height $H_s$. One additional reason the standard stabilizer adaptor unit 188 can be set on the outside of the water skirt 184 in this embodiment, is that sometimes the overflow pipe 26 extends too high above the water level line in the tank 18 when the tank is full. When the overflow pipe 26 extends too high, then the bottom of the water skirt 184 and standard stabilizer tube 188 are also above the water level line, and a chamber is not formed within the water skirt 184 and stabilizer adaptor unit 188. Therefore, in this embodiment, an extended stabilizer adaptor unit 204 may be used instead of the standard stabilizer adaptor unit 188. Referring to FIG. 6, an extended stabilizer adaptor unit 204 has replaced the standard stabilizer adaptor unit 188. The extended stabilizer adaptor unit 204 has a height $H_E$. The extended stabilizer adaptor unit 204 is configured to attach to an overflow pipe 26 that extends too high above the water level line, and still allow the bottoms of the extended stabilizer adaptor unit 204 and water skirt 184 to be below the water level line, thus forming a chamber within the stabilizer adaptor unit 204 and water skirt 184. This is because the extended stabilizer adaptor unit 204 is taller than the standard stabilizer adaptor unit 188, i.e. $H_E$ is greater than $H_s$.

Figure 7:
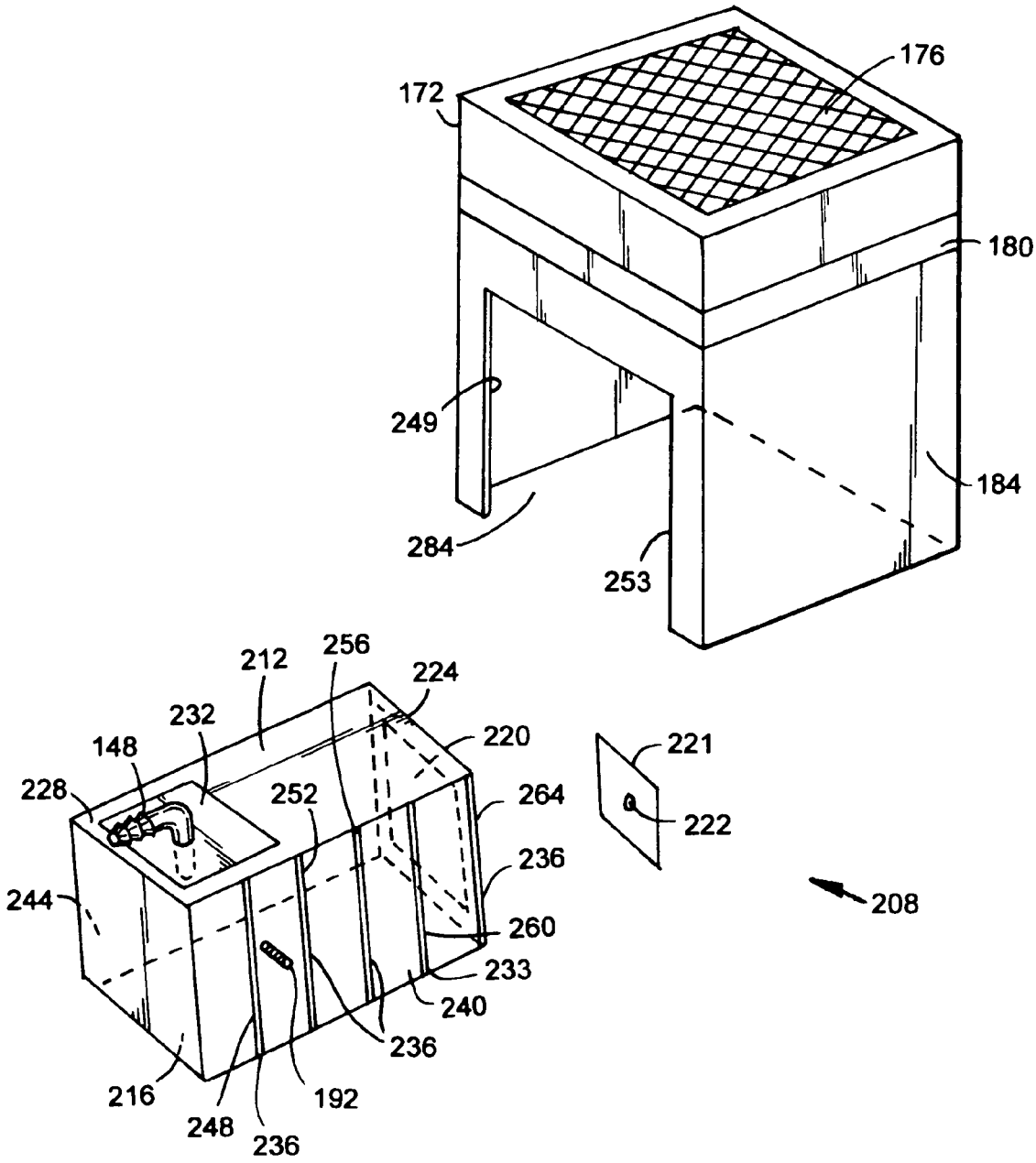
FIG. 7 is a perspective view of an extendible and retractable embodiment of the disclosed bathroom odor removal apparatus.

FIG. 7 shows a perspective view of another embodiment of an odor removal unit 208. In this unit, a housing 172 encloses a filter 176 and a blower fan 180. The housing 172 extends into a water skirt 184 which is open at the bottom. Removeably attached to the water skirt 184 is an adjustable stabilizer adaptor unit 212 that is configured to slide over an overflow pipe 26. The adjustable stabilizer adaptor unit 212 is open at its bottom 216 and has a rear opening 220 on a rear wall 224.

The top wall 228 of the adjustable stabilizer adaptor unit 212 does not have an opening in this embodiment, however it does have a openable panel 232. The interior surface of the top wall 228 shall refer to the surface on the side of the top wall that faces the bottom 137 of the water skirt 184. The top surface of the top wall 228 shall refer to the side opposite of the interior surface. Similarly, the rear opening 220 is generally closed by a panel 221, that may be removed when used in an external installation of the adjustable stabilizer adaptor unit 212 on the water skirt 184. The panel 221 has a panel opening 222. A locking screw 192 is configured to lock the adjustable stabilizer adaptor unit 212 onto an overflow pipe 26. The water skirt 184 has a side opening 284 with a first opening edge 249 and second opening edge 253. A plurality of vertical grooves 236 are located on the first side wall 240, and on the second side wall 244 (the grooves 236 on the second side wall 244 are not visible in this view). The grooves are configured such that a pair of grooves (one on each of the first side wall 240 and second side wall 244) are able slide over the first opening edge 249 and second opening edge 253 of the water skirt 184. Each pair of grooves 236 will be referred to as a "set of grooves". In this embodiment, there are a first set 248 of grooves, second set 252 of grooves, third set 256 of grooves, a fourth set 260 of grooves, and a fifth set 264 of grooves. However, one of ordinary skill will understand that more and less than 5 sets of grooves 236 may be used with the adjustable stabilizer adaptor unit 212.

Depending on which pair of grooves 236 used to slide onto the first opening edge 248 and second opening edge 252, the adjustable stabilizer adaptor unit 212 can be adjustably extended out of the water skirt 184 or retracted into the water skirt 184. Attached to the openable panel 232 is an adapter 148 configured to couple to a refill tube 144. The adapter is configured to allow fluid communication between the refill tube and the overflow pipe 26 when the overflow pipe is inserted into the adjustable stabilizer adaptor unit 212.

Figure 8:
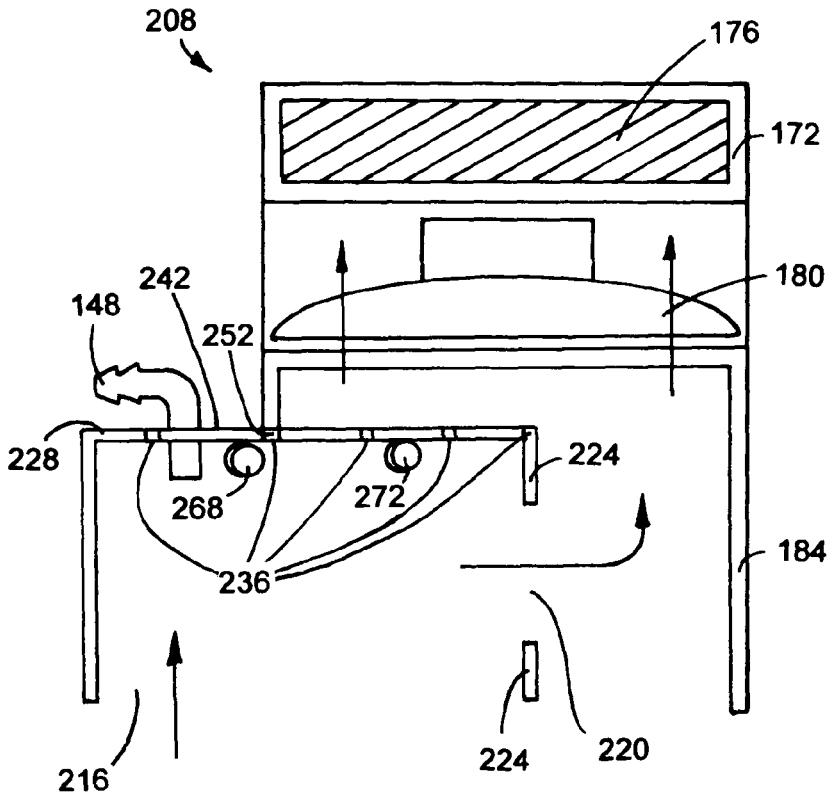
FIG. 8 is a cross-sectional view of the bathroom odor removal apparatus from FIG. 7.

FIG. 8 shows a cross-sectional view of the odor removal unit 208 from FIG. 7, with the adjustable stabilizer adaptor unit 212 installed upon a second set 252 of grooves 236. A first set of clips 268 and a second sit of clips 272 are shown on the interior side of the top wall. These clips 268, 272 are to be used when the adjustable stabilizer adaptor unit is used in an internal installation configuration, as will be seen in FIG. 10. The arrows indicate possible pathways that the air may take. Also shown in this view are a first set of clips 268 and a second set of clips 272 attached to the interior surface of the top wall 228.

Figure 9:
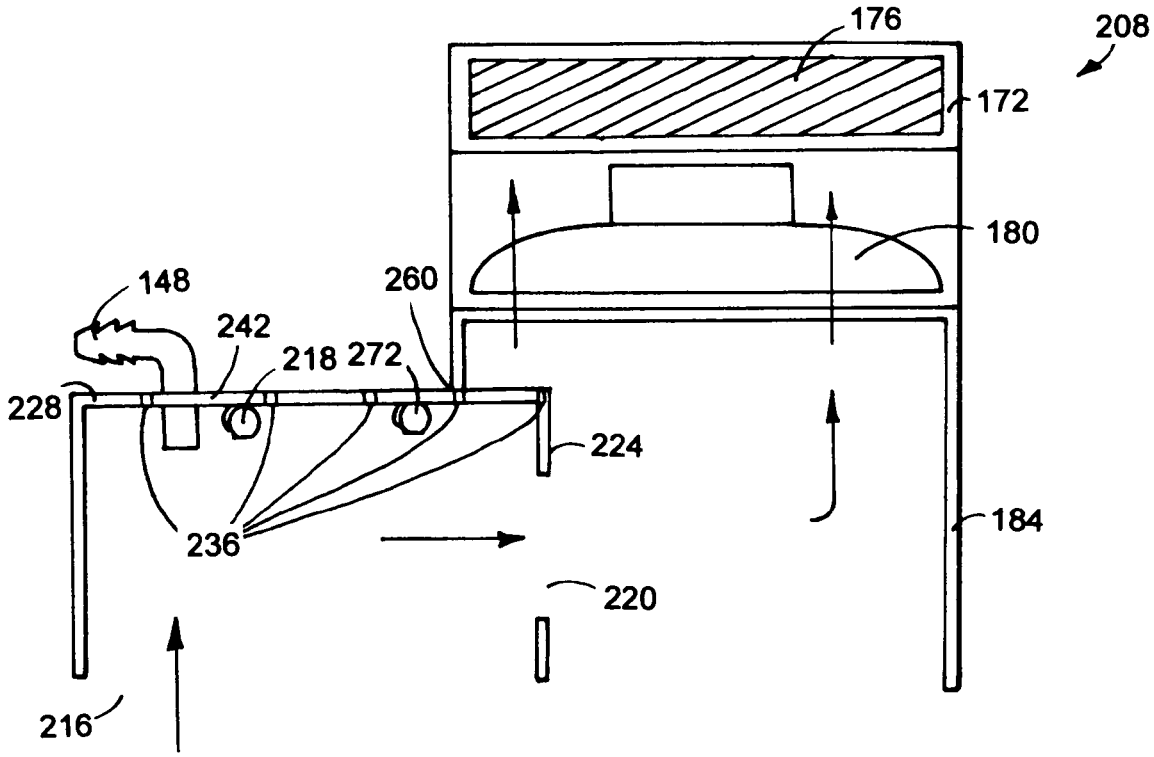
FIG. 9 is a cross-sectional view of the bathroom odor removal apparatus from FIG. 8 with the adjustable stabilizer adaptor unit extended.

FIG. 9 shows a cross-sectional view of the odor removal unit 208 from FIG. 7, with the adjustable stabilizer adaptor unit 212 installed upon a fourth set 260 of grooves 236. Thus, comparing the configuration shown in FIG. 9 with that shown in FIG. 8, one can see how the adjustable stabilizer adaptor unit 212 can be adjusted to extend further from the water skirt 184 (as shown in FIG. 9), or be retracted into the water skirt 184 (as shown in FIG. 8). The arrows indicate possible pathways that the air may take.

Figure 10:
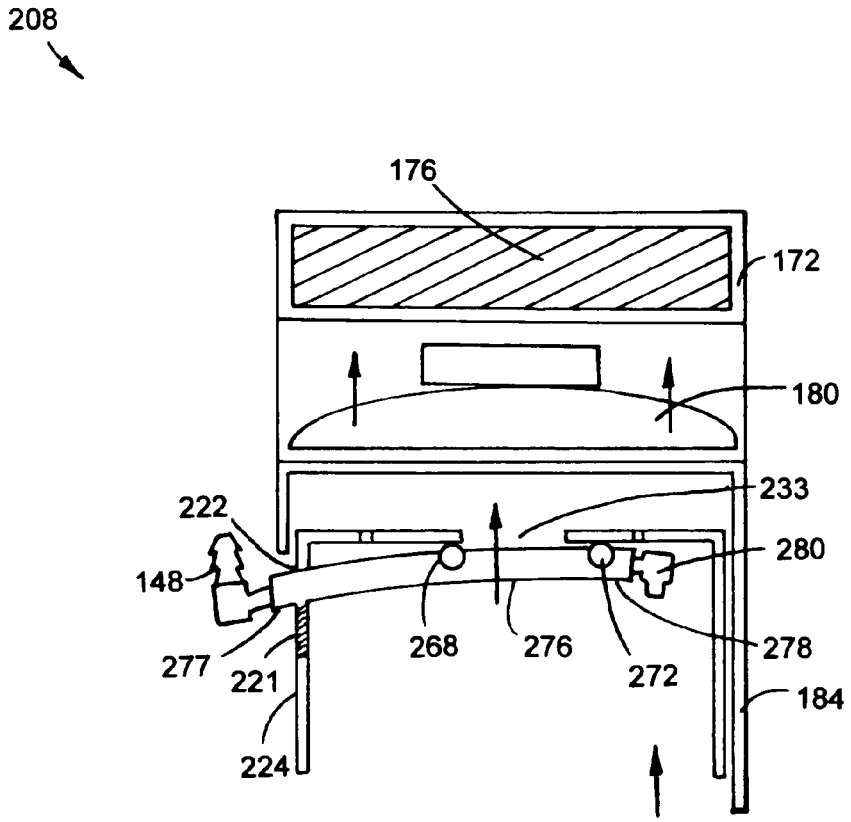
FIG. 10 is a cross-sectional view of the bathroom odor removal apparatus from FIG. 9 with the adjustable stabilizer adaptor unit installed in an internal mounting configuration.

FIG. 10 shows an internal installation of the adjustable stabilizer adaptor unit 212 into the odor removal unit 208. In this embodiment, the rear opening panel 221 is left on the rear wall 224. The adjustable stabilizer adaptor unit 212 has been turned around such that the rear wall 224 is adjacent to the water skirt first opening edge 249 and the water skirt second opening edge 253. In this configuration, the top wall opening panel 232 is removed, leaving a top wall opening 233. A conduit 276 passes through the opening 222 in the rear opening panel 221. The conduit 276 is held in place by the clips 268, 272. Attached at a first end 277 of the conduit 276, and located outside of the water skirt 184, is the adapter 148. Attached at a second end 278 of conduit 276, is a overflow pipe adapter 280. The overflow pipe adapter 280 is configured to direct fluid from the a refill tube 144 into an overflow pipe 26. The arrows indicate possible pathways that the air may take.

The embodiment shown with respect to FIGS. 7-10 illustrates that the adjustable stabilizer adaptor unit 212 makes the odor removal unit 208 very adaptable to the various situations that may be encountered when installing the device. The disclosed odor removal unit 208 has a plurality of mounting positions and also can be installed as an internal or an external mounting.

In still another embodiment, the disclosed odor removal unit may be used as a toilet "tank top unit". This may done when the physical constraints of the toilet tank interior make internal mounting impractical. The disclosed odor removal units are also effective in controlling cat box, laundry room, ashtray and other odors that emanate about a limited area. To get the best effect from this type of usage the disclosed odor removal unit may be placed in close proximity to the source of the offending odor. This device, when left to run in the open air is quite effective at freshening the air for a limited area around the device. This has been found to be true even for limited areas in larger rooms. For instance, near an ash tray, in a room or near a cat litter box in a large basement. The stabilizer adaptor unit opening may be aimed at the target odor for better effectiveness. Some alternate uses for the disclosed odor removal unit are: near an open cat litter box; on top of the vent on an enclosed cat litter box; next to an ash tray or over a small ash tray. near hampers, in laundry rooms; near dog beds and other smelly pet areas; on top of toilet tanks for toilets that cannot accommodate the device being installed internally; in a bathroom without an exhaust fan; used diaper storage; and anywhere that low volumes of often intense, localized odors exist.

Automatic Control and Battery Power Supply

Figure 11:
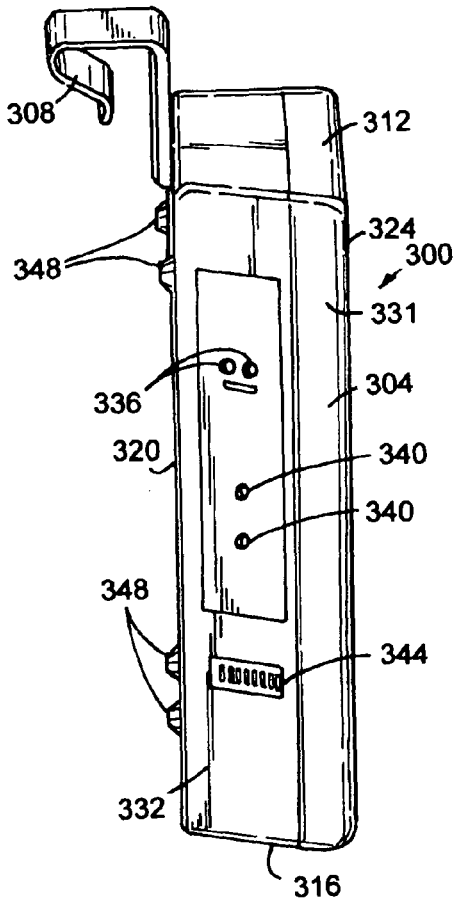
FIG. 11 is a front perspective view of the disclosed automatic control and battery power supply.
Figure 12:
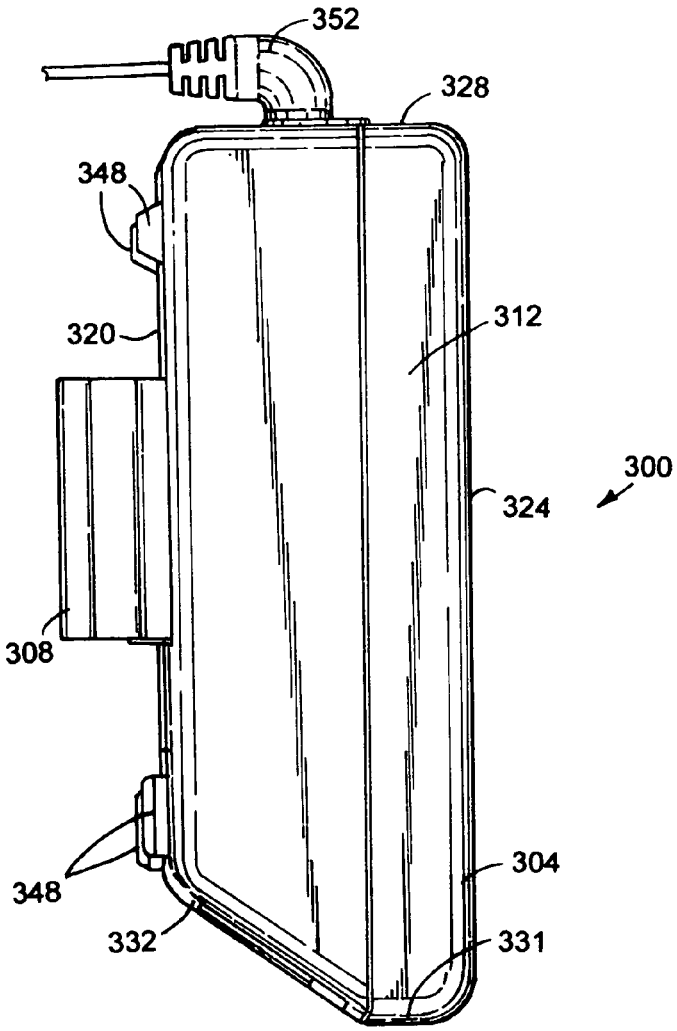
FIG. 12 is a top view of the disclosed automatic control and battery power supply.

FIG. 11 shows a side perspective view of the disclosed automatic control and battery power supply 300. The disclosed automatic control and battery power supply 300 may be configured to replace the controller 102 and power supply 106 shown in FIGS. 1 and 2, or the power supply 106 and controller in the in the housing 122 in FIG. 4, or the power supply 106, and controller in the housing 172 from FIGS. 5 and 6, or the power supply 106 and controller in the housing 172 from FIG. 8. In addition, the disclosed automatic control and battery power supply 300 may be used to replace an external power supply and controller for other embodiments of a bathroom odor removal system. FIG. 12 shows a top view of the automatic control and battery power supply 300. The automatic control and battery power supply 300 comprises a housing 304. A hanger 308 may be attached to the housing 304 via a slot 309 in the toilet tank face 320 (see FIG. 13). The housing comprises a plurality of faces, a top face 312, a bottom face 316, a toilet tank face 320, an away face 324, a back face 328, a front face 331 and a sensor face 332. The top face 312, bottom face 316, toilet tank face 320, away face 324, front face 331 and back face 328 form generally a box shape housing, with the faces either generally parallel or generally orthogonal to each other. However, the sensor face 332 is at an obtuse angle relative to the toilet tank face away face 320, as shown by the angle "$\alpha$". $\alpha$ may be between 180° and 90°, and preferably between 110° and 140°. This angulation of the sensor face 332 is important because when the automatic control and battery power supply 300 hangs from the toilet tank, with the toilet tank face 320 adjacent (and the face most near to the toilet tank) to the toilet tank, and the back face 328 facing towards the rear of the toilet tank (and away from the toilet), then the sensor face 332 will tend to face towards a user using the toilet see FIG. 19. The automatic control and battery power supply 300 also has a sensor 336 located on the sensor face 332. The sensor 336 may be an area reflective sensor, motion sensor, heat sensor, or any other suitable sensor for detecting the presence of a person, or a combination of suitable sensors. One or more display lights 340 may be located on the sensor face 332. Also located on the housing is a user input device 344. The user input device 344 may be a menu driven touch screen, a wireless internet connection, or, as shown, a plurality of dip switches. The toilet tank face 320 has a plurality of protuberances 348. The protuberances keep the housing 304 from lying directly against the toilet tank, which helps to keep condensation or other splashed water from becoming trapped between the toilet tank and the housing 304. The hanger 308 as shown in FIG. 11 allows one to hang the disclosed automatic control and battery power supply 300 from the right side of the toilet tank, when one is facing the toilet and the toilet tank, with the sensor face aimed toward the toilet. In other embodiments, the hanger 308, and housing may be configured to allow one to hang the automatic control and battery power supply 300 from the left side of the tank. An optional power cord 352 in communication with an ac/dc adapter is shown in FIG. 12.

Figure 13:
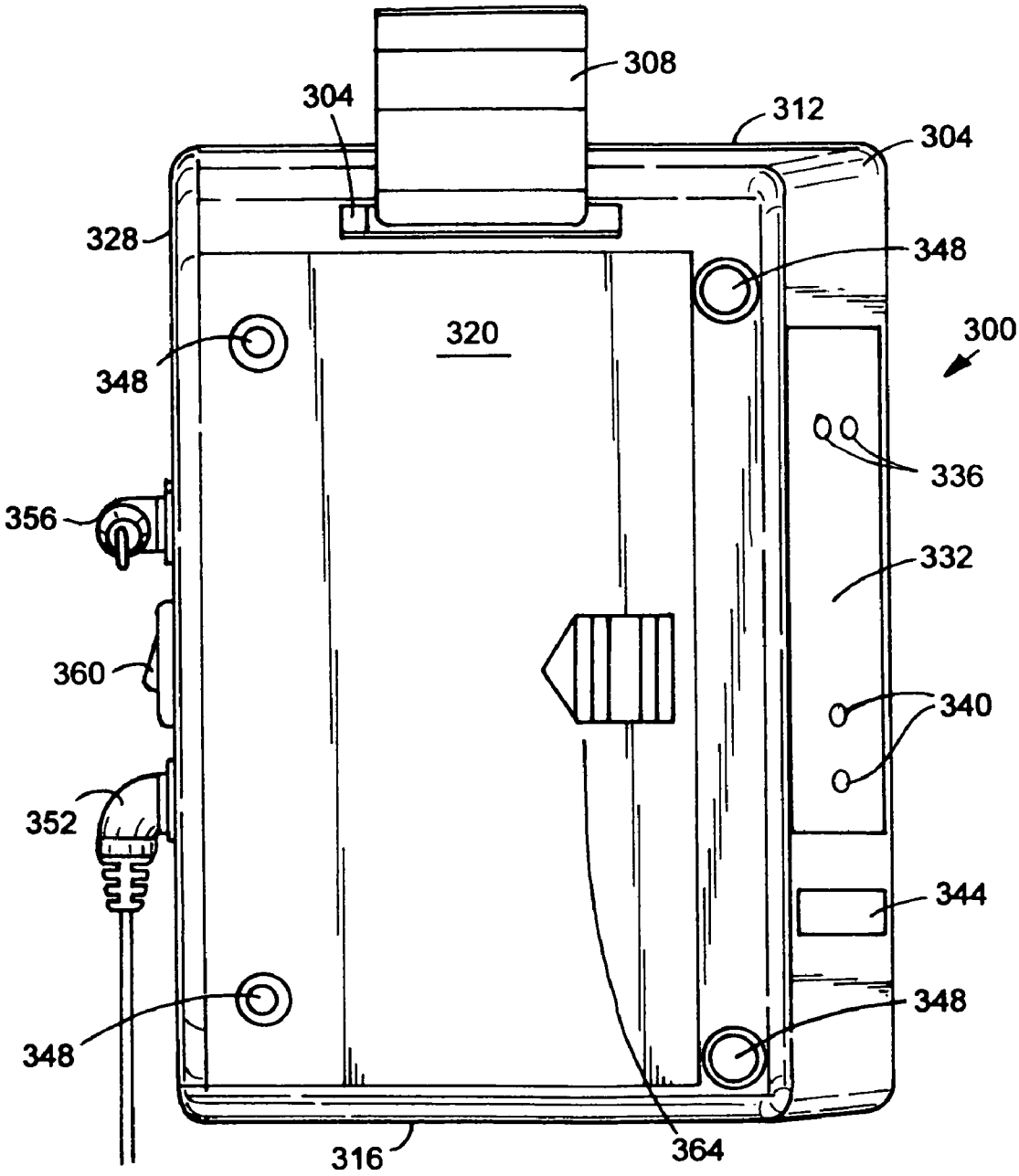
FIG. 13 is a side view of the disclosed automatic control and battery power supply.

FIG. 13 is a side view of the automatic control and battery power supply 300, looking at the toilet tank face 320 of the housing 304. In this view a plug 356 is shown located on the back face 328. The plug 356 may be connected to a cable or wire, which communicates with the controller 102 in the housing 304 and with the fan in the odor removal system/unit 120, 168, 208. An on/off switch 360 is also shown on the back face 328. This view also shows a removably attachable battery cover 364 on the toilet tank face 320.

Figure 14:
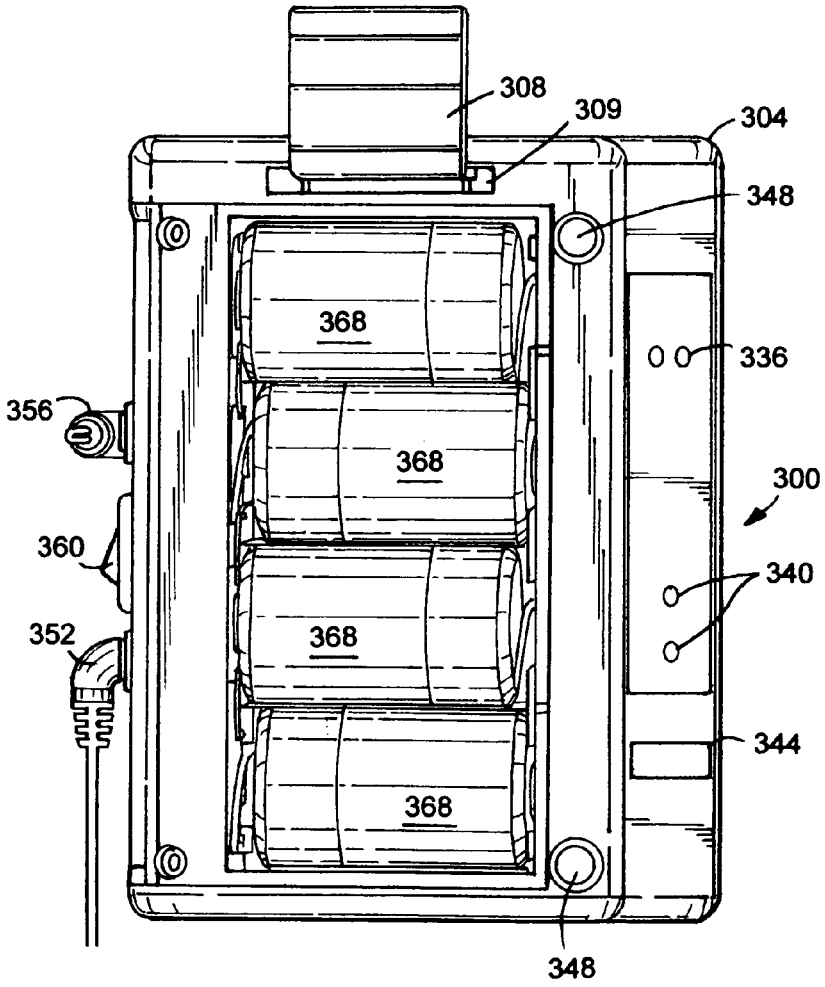
FIG. 14 is a side view of the disclosed automatic control and battery power supply, with the toilet side face removed.
Figure 15:
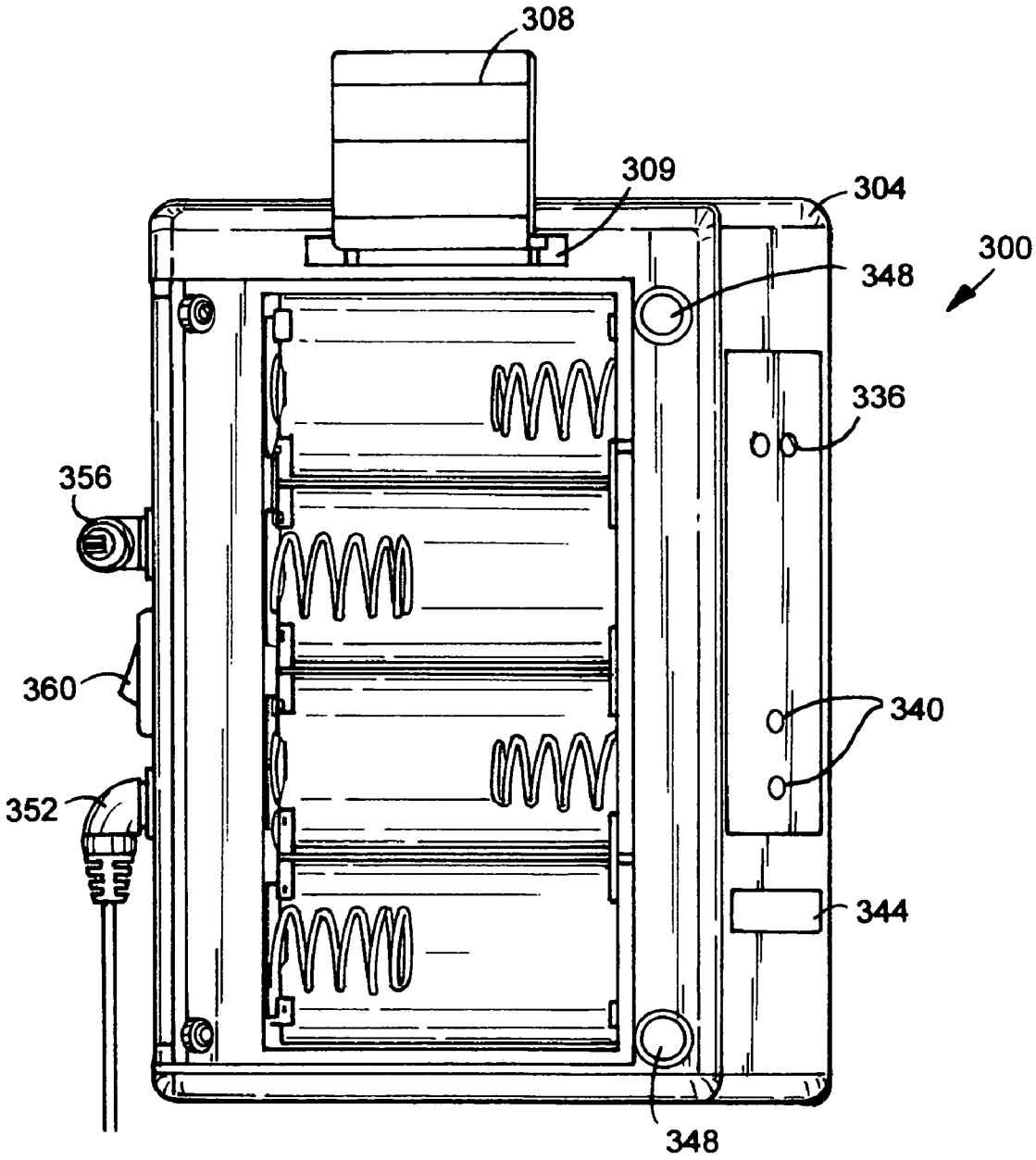
FIG. 15 is a side view of the disclosed automatic control and battery power supply from FIG. 14, with the power supply removed.

FIG. 14 shows the same view as from FIG. 13, but in this view the removably attachable battery cover 364 has been removed to show one or more batteries 368 inside the housing 304. FIG. 15 shows the same view as from FIG. 14, but this view has the batteries 368 removed from the housing 304. There are barricades on the + battery terminals which prevent contact in the event that a battery is inserted in the wrong direction. This prevents danger that may result from accidental, improper, insertion of the batteries.

The batteries shown are alkaline batteries, but one of ordinary skill in the art will recognize that the disclosed invention may be modified to work with any suitable battery including rechargeable batteries and other disposable batteries.

Figure 16:
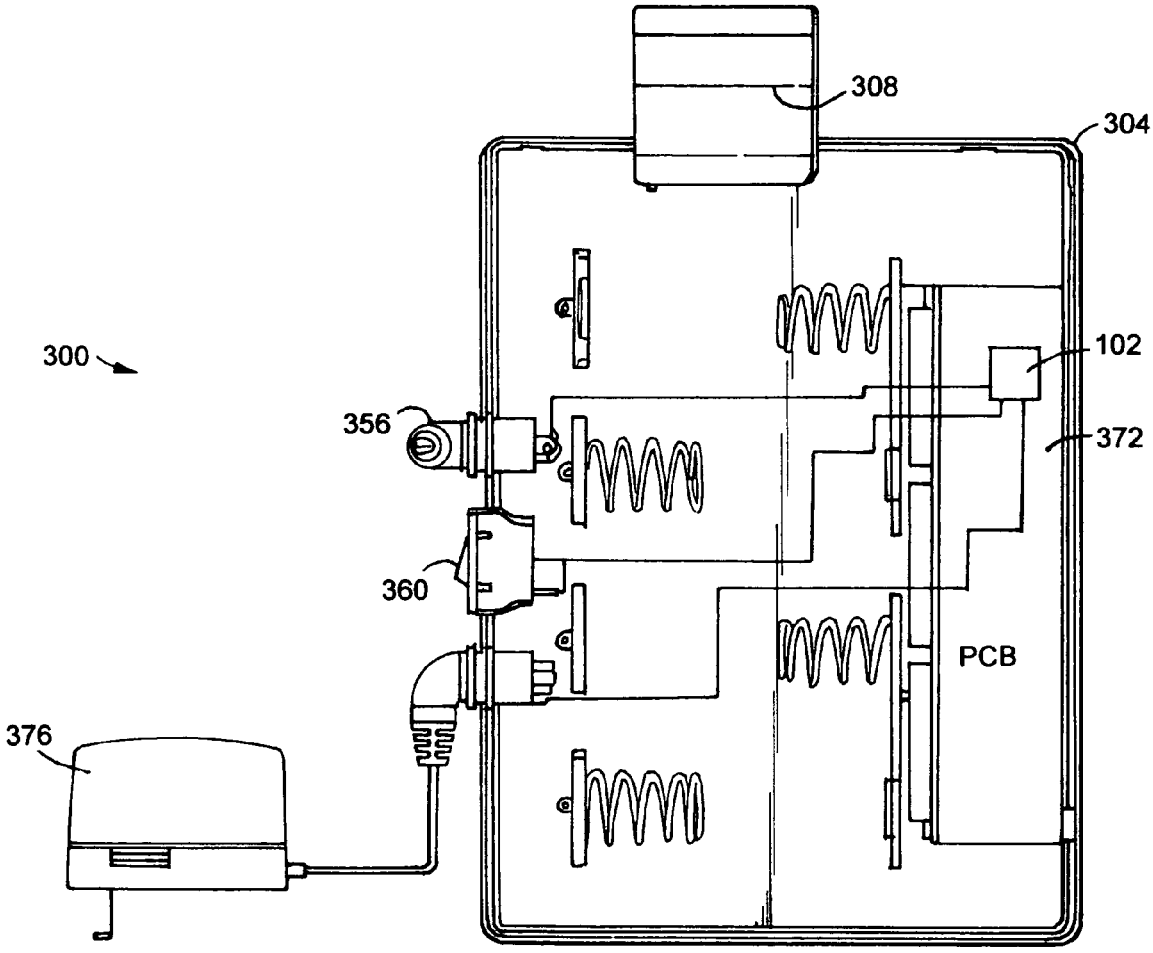
FIG. 16 is a side schematic view of the disclosed automatic control and battery power supply from FIG. 15, with the printed circuit board and controller shown.

FIG. 16 shows the automatic control and battery power supply 300 with the toilet tank face 320 and sensor face 332 removed. A printed circuit board 372 is shown inside the housing 304. The printed circuit board 372 may comprise a controller 102. The controller is in signal communication with the plug 356, on off switch 360, and power cord 352. In this figure the power cord 352 is shown in communication with an ac/dc adapter 376. The automatic control and battery power supply 300 is configured such that whenever the wall power supply is plugged in, the batteries are automatically disconnected from the circuit. In fact the batteries are not needed at all when the unit is under wall power but can remain in the unit, if desired, as a back-up power supply.

Figure 17:
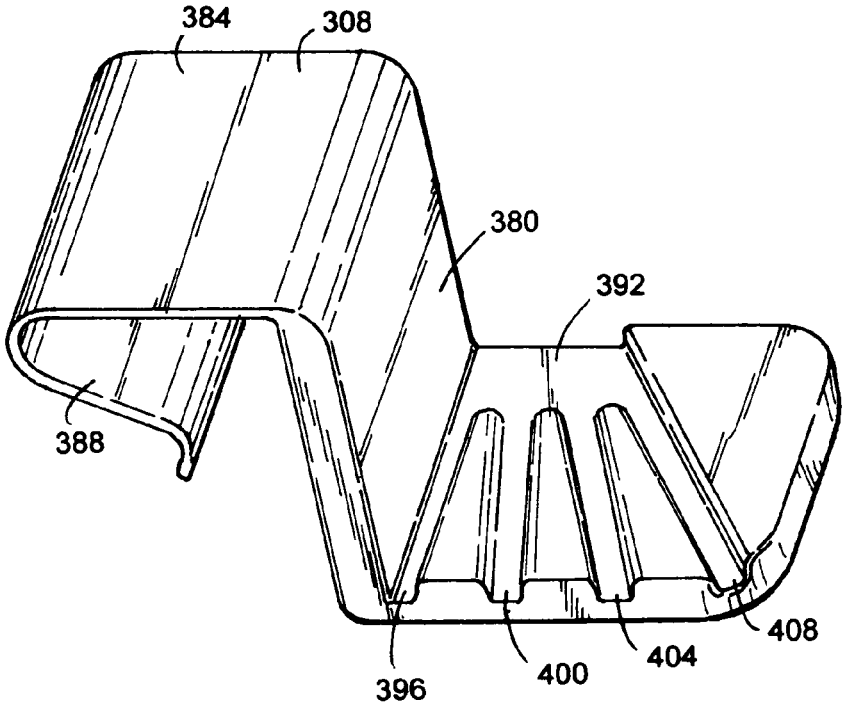
FIG. 17 is a perspective view of the hanger.
Figure 18:
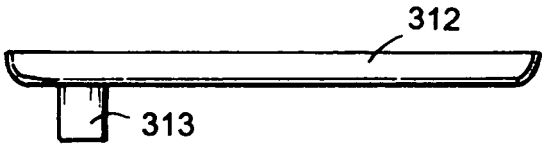
FIG. 18 is a front view of the top face and protruding member.

FIG. 17 is a perspective view of the hanger 308. The hanger 308 comprises a main member 380, a top orthogonal member 384 in communication with the main member 380, inwardly curved member 388 in communication with the top orthogonal member 384, and a grooved bottom orthogonal member 392 in communication with the main member 380. The grooved bottom orthogonal member 392 has a plurality of grooves 396, 400, 404 and 408 located on the top surface of the grooved bottom orthogonal member 392. Groove 396 is at about a 0° angle with respect to the main member 380, groove 400 is at about a 10° angle with respect to the main member 380, groove 404 is at about a 20° angle with respect to the main member 380, and groove 408 is at about a 30° angle with respect to the main member 380. FIG. 18 shows a front view of the top face 312. The interior surface of the top face 312 has a protruding member 313 configured to sit in any of the grooves 396, 400, 404, 408. Thus a user can slide the grooved bottom orthogonal member 392 into the slot 309 in the housing 304, and have the protruding member engage anyone of the grooves 396 through 408. If the protruding member 313 engages groove 396, then the toilet tank face 320 and away face 324 will generally be parallel to the main member 380. If the protruding member 313 engages groove 400, then the toilet tank face 320 and away face 324 will generally be at about a 10° angle to the main member 380. If the protruding member 313 engages groove 404, then the toilet tank face 320 and the away face 324 will generally be at about a 20° angle to the main member 380. If the protruding member 313 engages groove 408, then the toilet tank face 320 and the away face 324 will generally be at about a 30° angle to the main member 380. Hanger 308 could also be configured differently to accommodate attachment of the automatic control and battery power supply 300 to any other special toilet tanks.

Figure 19:
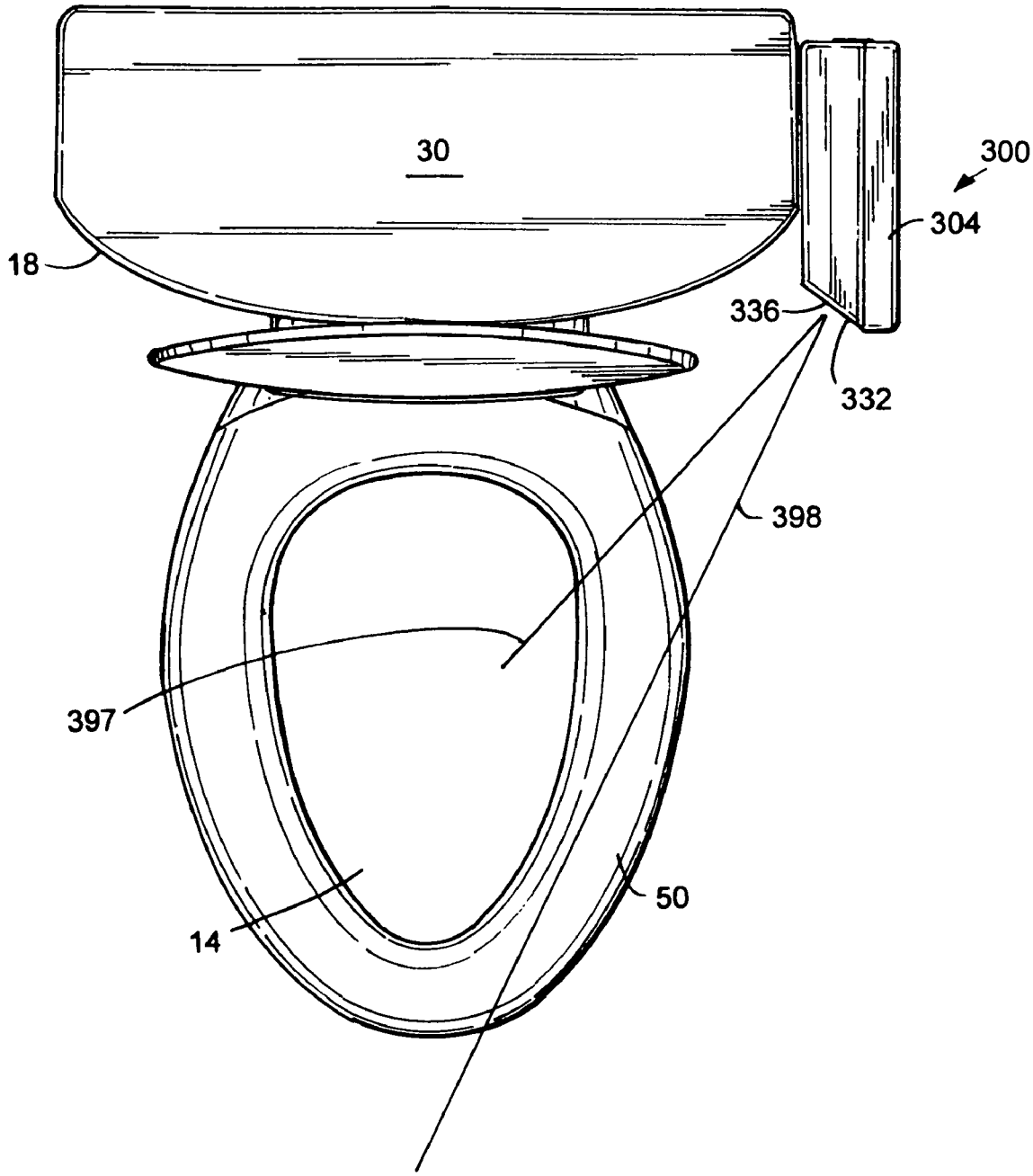
FIG. 19 is a top view of a toilet and the disclosed automatic control and battery power supply hanging from a toilet tank.
Figure 20:
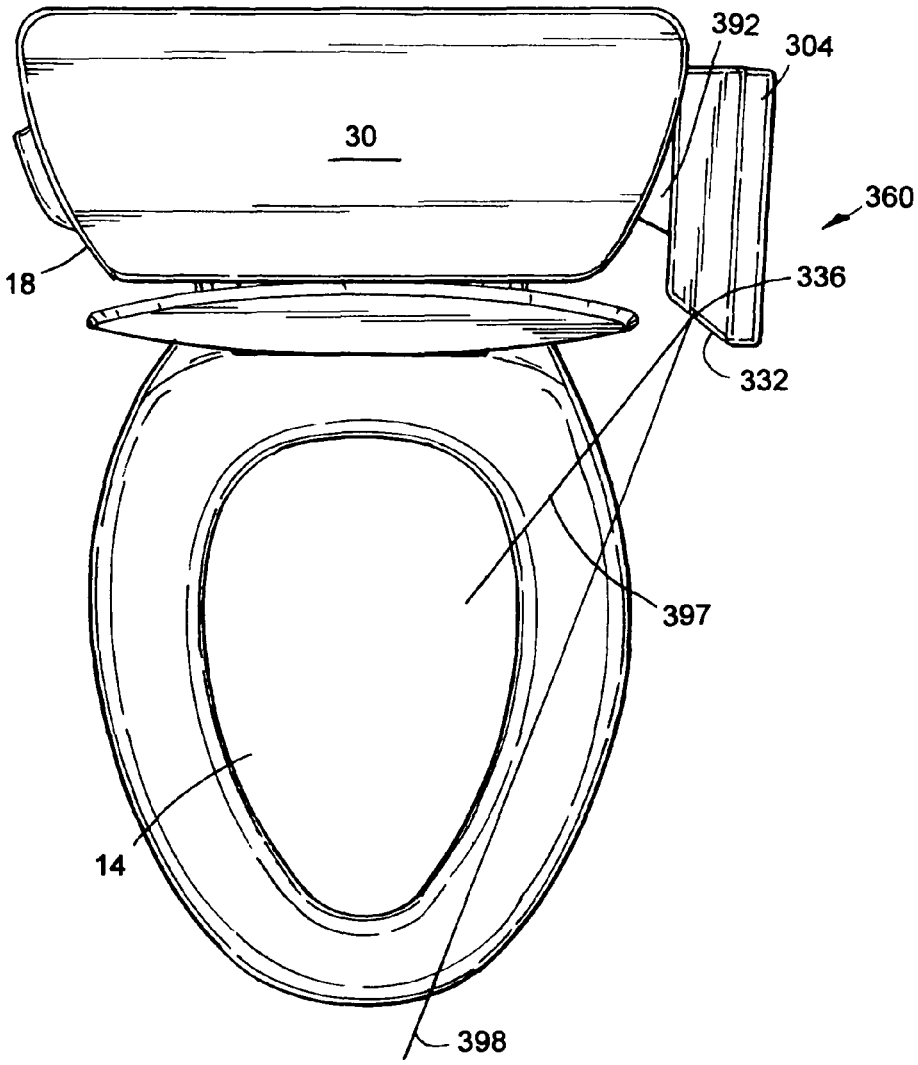
FIG. 20 is a top view of a toilet and the disclosed automatic control and battery power supply hanging from a different style toilet tank than shown in FIG. 19.

FIGS. 19 and 20 shows how the housing can be adjusted with respect to the hanger, in order to have the sensor 336 on the sensor face 332 aimed at a person sitting on the toilet. The included angle between line 397 going from the sensor to generally the center of the toilet bowl 14, and line 398 going from the sensor 336 to a space directly in front of the toilet bowl 14 represents the "target area" for notifying the controller 102 of an occupant using the toilet. The sensor range is limited to avoid false triggering as persons walk past or stand in front of the toilet. The general diagonal angle across the toilet seat also helps to avoid false triggering. In FIG. 19, the sides of the toilet tank 18 are generally square, thus with this type of configuration, a user would use groove 396, in order to keep the sensor face 332 aimed towards the toilet bowl 14 and a space directly in front of the toilet bowl 14. In FIG. 20, the sides of the toilet tank 18 are angled in, thus a user may use groove 404 or 408 in order to have the sensor face 332 properly aimed at the target area.

Figure 21:
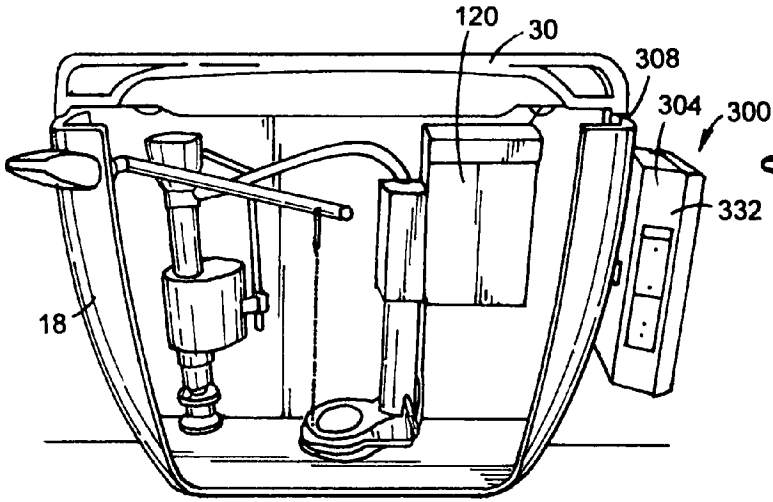
FIGS. 21 through 24 are front views through a toilet tank, showing how the disclosed automatic control and battery power supply can be aimed differently.
Figure 22:
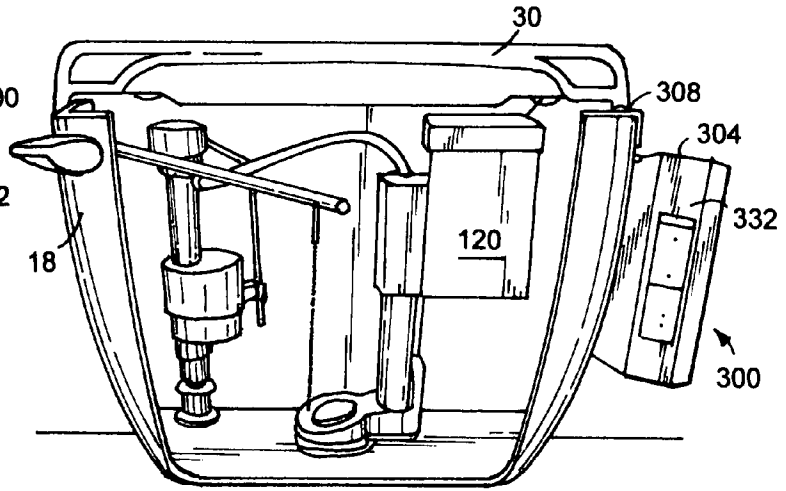
Figure 23:
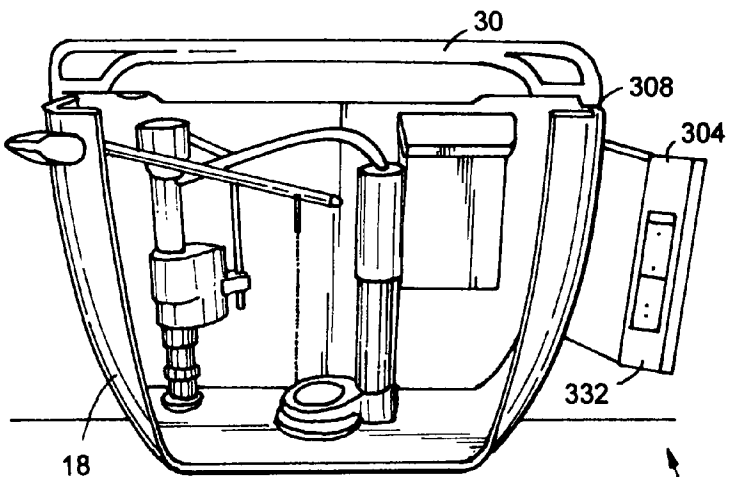
Figure 24:
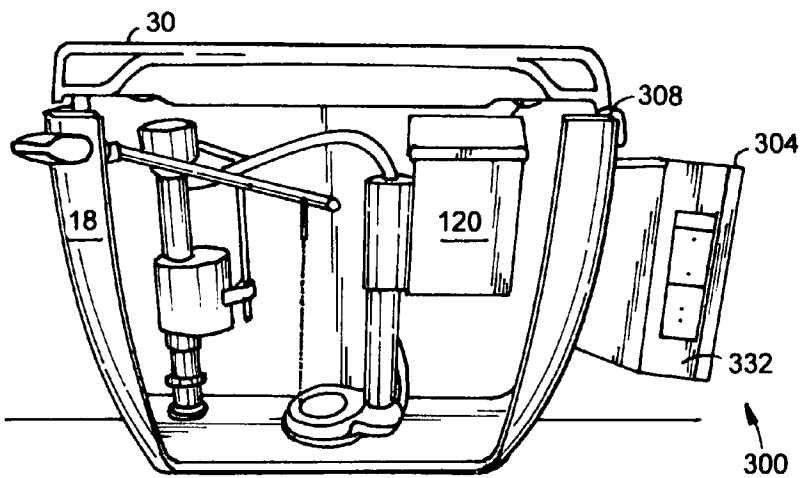

FIGS. 21-24 are all front views through a toilet tank 18 showing an odor removal unit 120 installed in the tank. In FIG. 21, the protruding member is in slot 396. In FIG. 22, the protruding member is in slot 400. In FIG. 23, the protruding member is in slot 404. In FIG. 24, the protruding member is in slot 408. One can see how the housing 304 becomes angled more away from the toilet bowl as the protruding member is moved from slot 396 through slot 408. This gives a user the ability to aim the sensor face 332 towards the target area, no matter the configuration of the toilet tank and/or toilet bowl.

The user input device 344 may be, in one embodiment, a set of dip switches. In a particular embodiment the user input device 344 may be a set of eight (8) dip switches. The dip switches, in one configuration, may allow for the programming of the controller 102 as shown in Table 1 below.

TABLE 1

8 Segment Dip Switch Functions

| Switch position(s) | Function | Purpose | Selections | Outcome | Default | Notes |
|---|---|---|---|---|---|---|
| 1 & 2 | Fan Speed | Adjusts static pressure to compensate for various toilet designs | off-off | Motor voltage = 3.5 V | | Maximum battery life & Minimum static pressure |
| 1 & 2 | Fan Speed | Adjusts static pressure to compensate for various toilet designs | off-on | Motor voltage = 3.75 V | X | This setting gives decent battery life and works well with most toilets |
| 1 & 2 | Fan Speed | Adjusts static pressure to compensate for various toilet designs | on-off | Motor Voltage = 4 V | | Reasonable battery life with increased air flow |
| 1 & 2 | Fan Speed | Adjusts static pressure to compensate for various toilet designs | on-on | Motor Voltage = 4.5 V | | Reduced battery life & Maximum static pressure - only for where needed |
| 3 | Auto operation | For automated operation on a toilet bowl | on | Automatic operation | X | Always use this setting for battery power operation |
| 3 | Auto operation | For continuous toilet operation or for other uses such as for use with a cat litter box or as a room air freshener | off | Fan runs continuously | | Should only be used with external 120 Volt, wall pack, power supply |
| 4 | Audible sounder | Warns of a low battery condition or a fan malfunction. The sounder beeps only one or two short blasts upon fan startup. | on | Sounder on | X | Sounder "on" Provides the most positive reminder for maintenance. |
| 4 | Audible sounder | Sounder "off" avoids the unit drawing attention to itself by curious children or someone who is easily frightened. | off | Sound off | | There is also a "maintenance light" on the front panel, that mirrors the sounder function but remains on as long as the fan is running. This light will continue to operate when the sounder is turned off |
| 5 | Sensor Sensitivity | Adjusts the maximum distance that the sensor can detect a body. | on | High Sensitivity | X | Provides the most positive detection of a body. |
| 5 | Sensor Sensitivity | Adjusts the maximum distance that the sensor can detect a body. | off | Low sensitivity | | Helps reduce false triggering - where needed |
| 6 & 7 | Over-run time | Cleans up any residual odors after the body is done toileting and leaves the detection area. | off-off | 0.5 Minutes | | Maximizes battery life - Minimum residual air clean-up |
| 6 & 7 | Over-run time | Cleans up any residual odors after the body is done toileting and leaves the detection area. | off-on | 2.0 Minutes | X | Slightly reduced battery life - Good Average residual air clean-up |
| 6 & 7 | Over-run time | Cleans up any residual odors after the body is done toileting and leaves the detection area. | on-off | 4.0 Minutes | | Moderately reduced battery life - Very Good residual air clean-up |
| 6 & 7 | Over-run time | Cleans up any residual odors after the body is done toileting and leaves the detection area. | on-on | 6.0 Minutes | | Substantially reduced battery life - Best residual air clean-up |
| 8 | Spare | | | | | |

Table 2 shows how the automatic control and battery power supply 300 may be configured to operate.

TABLE 2

A BRIEF DESCRIPTION OF CONTROL UNIT FUNCTIONS & TIMING

| Function | Description | Demo Unit | Personal Unit |
|---|---|---|---|
| 1) Turn On Power | Energizes the Control Unit via either battery or 120 volt wall outlet power adaptor. | | |

TABLE 2-continued

A BRIEF DESCRIPTION OF CONTROL UNIT FUNCTIONS & TIMING

| Function | Description | Demo Unit | Personal Unit |
|---|---|---|---|
| 2) Boot-Up Time | Upon turning on power, the unit will Ignore everything and sit for 21 seconds blinking the red light | 21 Seconds | 21 Seconds |
| 3) Motion Sense To Triggering Fan Time | The "sense-time window" used to analyze detected motion and decide if fan activation is appropriate. If the motion sensor indicates motion for more than 28% of the time during this window, consider motion to be truly detected, otherwise look for motion for one additional period before going back to sleep. | 5 Seconds | 5 Seconds |
| 4) Maximum Fan Run-Time | The maximum contiguous time-period the fan can be on. When this limit is hit, the unit will turn off the fan and go to sleep. Note that if the motion sense is active immediately after the unit goes to sleep, it will wake back up again. | 30 Minutes | 30 Minutes |
| 5) Pee Power-Preservation Threshold (PPP Threshold) | When motion is first detected, the computer takes a First Motion Sense Time sample and stores it. At the conclusion of the Fan Time period, the firmware looks at the last motion sense time and if the difference is more than the PPP Threshold, the fan will continue to be powered for the Overrun Time. If the difference is less than the PPP Threshold, the unit will go to sleep. So in our case now, if 100 sec occurred between the first and last motion sense, the fan will shut off 180 sec (Fan Time) after the last motion sense. If 150 sec occurred between the first and last motion sense, the fan will shut off 360 sec after the last motion sense (Fan Time + Overrun Time). | 30 Seconds | 120 Seconds (2 Minutes) |
| 6) Overrun Time | The amount of time the fan continues to run after the toilet has been used and vacated. This function is intended to remove residual odors. See Fan Time for details of operation. | | |
| 7) Fan Time | This is the time period the fan will continue to run after the last motion sense, irrespective of when the first motion sense occurs. Fan Time will occur whether one has exceeded the PPP threshold or not. For example, if the last motion sense, on a Personal Unit, was at 1:00, the fan will shut off at 1:03 if less than the PPP Threshold, and at 1:06 if more than the PPP Threshold. | 20 Seconds | 180 Seconds (3 Minutes) |
| 8) Sleep Mode | The condition where the unit is waiting for an initiating motion signal. Under this condition, only the sensor and minimal support circuitry are powered and the computer processor is shut off, thus conserving power. Whenever a motion is sensed, the unit will immediately exit Sleep Mode. The unit will return to sleep mode if the Motion Sense To Triggering Fan Time is not exceeded or after the Overrun Time has ended. | | |
| 9) Expected Battery Life | The battery life is expected to be roughly 120 hours. This could vary depending on several factors including the type and brand of battery, frequency and duration of use. | 120 Hours | 120 Hours |
| 10) Low Battery Warning Light | A red warning light will begin to flash when the fan becomes energized and the battery condition is about 95% depleted. This indicates that about 6 hours of fan operation remain before the unit will shut down due to a failed battery condition. | | |
| 11) Low battery Warning Sounder | A single, short duration, warning sound will be emitted when the fan becomes energized and the battery condition is about 95% depleted as in #10 above. The single beep is intended to bring attention, without being annoying, to the battery condition light, which might otherwise go un-noticed. | | |

Figure 25:
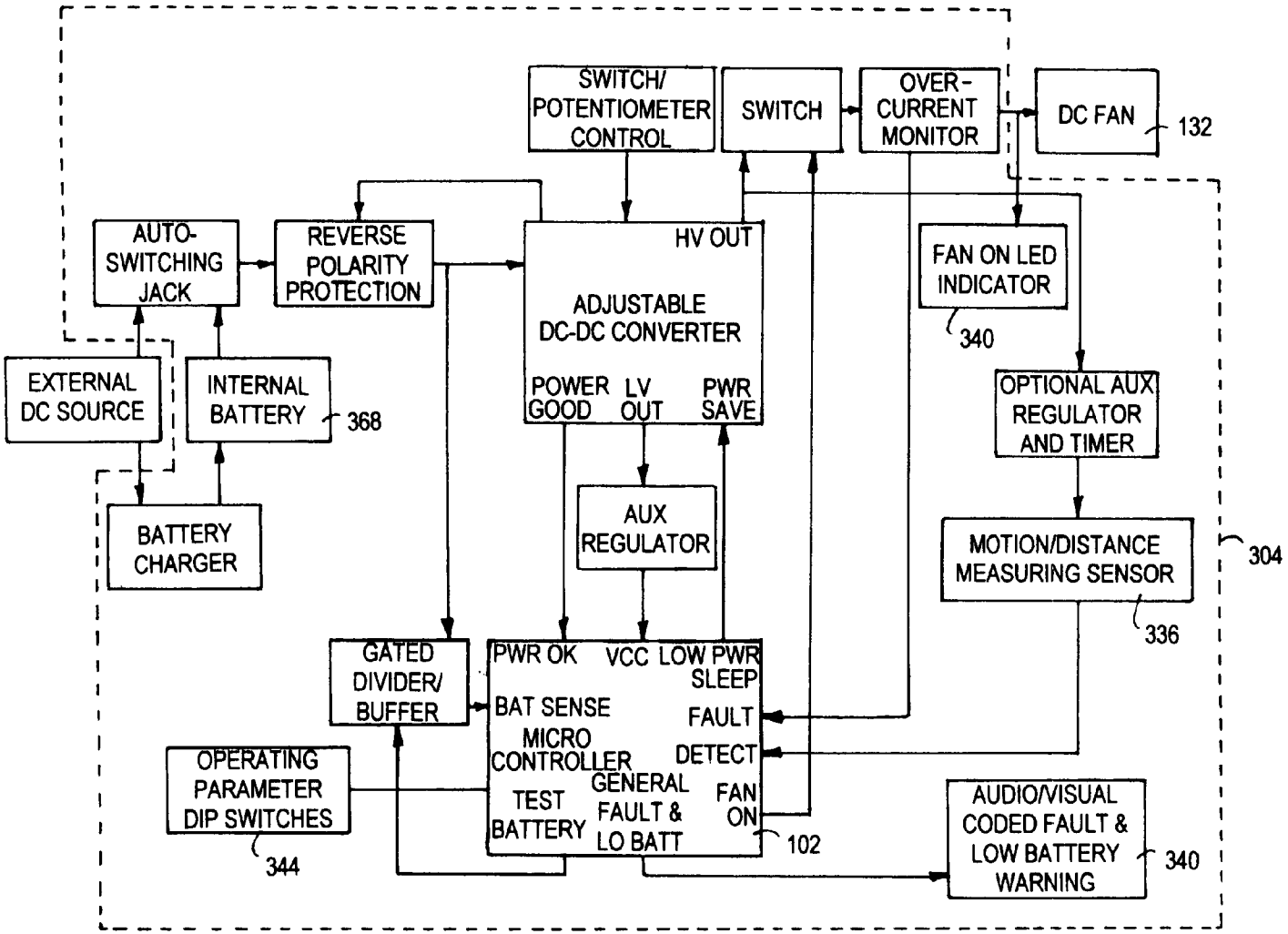
FIG. 25 is a schematic diagram of the disclosed automatic control and battery power supply.

FIG. 25 is a block diagram showing the components that are in or directly attached to the housing 304. The dashed line 304 represents the housing 304. The external dc source is the ac/dc adapter wall adapter 376. The blower fan (dc fan) 132 is located in the odor removal unit 120. The controller (micro-controller) 102 is in signal communication with an auxiliary regulator, an adjustable DC-DC converter, a gated divider/buffer, user input device (dip switches) 344, display lights (audio/visual coded fault and low battery warning) 340, sensor (motion/distance measuring sensor) 336, and overcurrent monitor. The external dc source may be in communication with a battery charger. The battery charger may be in communication with the batteries 368. An auto switching jack may be in charge with the batteries 368 and with a reverse polarity protection device. The adjustable DC-DC converter is also in signal communication with the reverse polarity protection device, a switch/potentiometer control, a switch, and the auxiliary regulator. The switch is in signal communication with an overcurrent monitor, the overcurrent monitor is in signal communication with the blower fan 132. The blower fan 132 and overcurrent monitor are in signal communication with the display lights 340. An optional auxiliary regulator and timer is in signal communication with the adjustable DC-DC converter and the sensor (motion/distance measuring sensor) 336.

Figure 26:
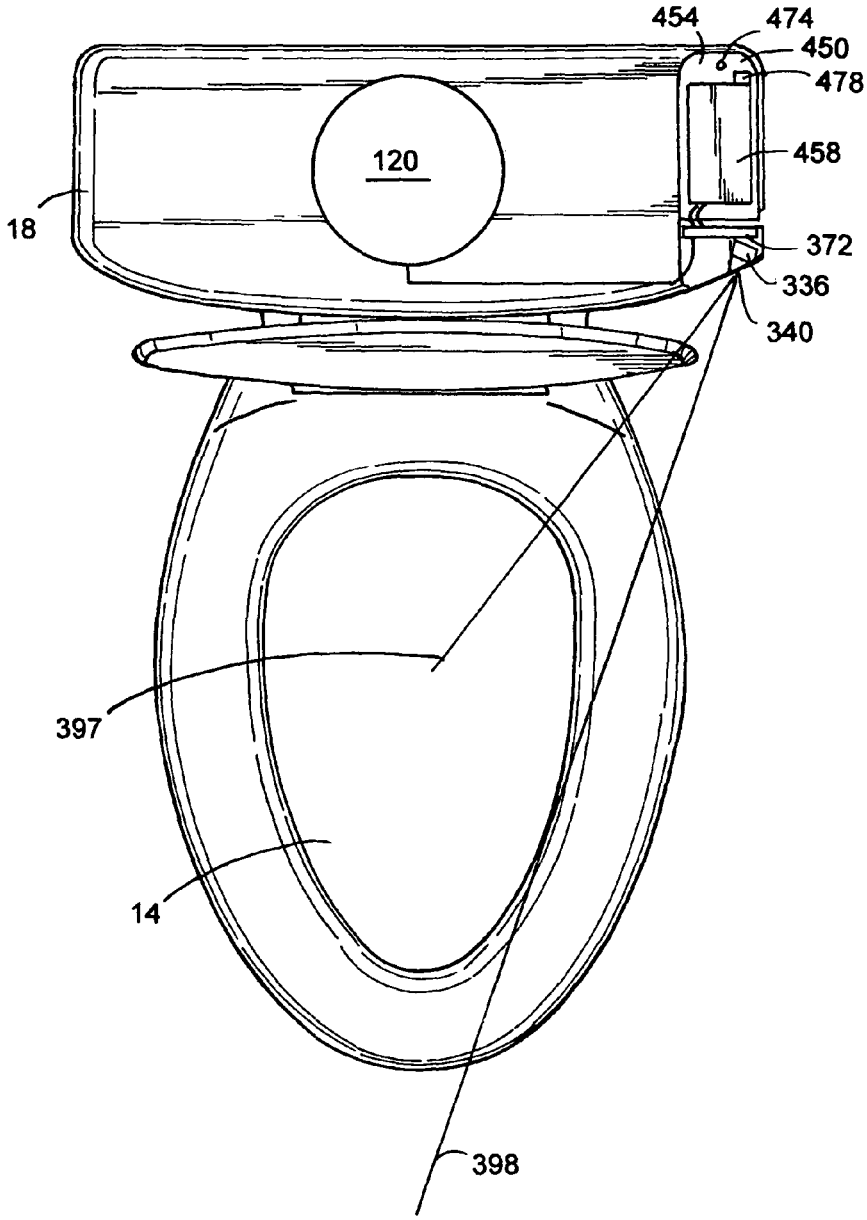
FIG. 26 is a top schematic view of another embodiment of the disclosed automatic control and battery power supply.

Another embodiment of the automatic control and battery power supply, is one where it is attached to the interior of a toilet tank, either by an original equipment manufacturer or after market retrofitter. FIG. 26 shows a top view of a toilet tank installed with an odor removal unit 120 which is in signal communication with an automatic control and battery power supply 450. The automatic control and battery power supply 450 comprises a housing 454. Inside the housing 454 is a power supply, 458 such as disposable or rechargeable batteries. A printed circuit board 372 with a controller 102 located on it, is inside the housing 454. Sensors 336 are positioned on the front of the housing 454. Display lights 340 are also located in the front of the housing 454. There is a drain hole 474 located in the housing. Additionally there is an optional connector 478 for an external source of power, such as a ac/dc wall adapter.

Figure 27:
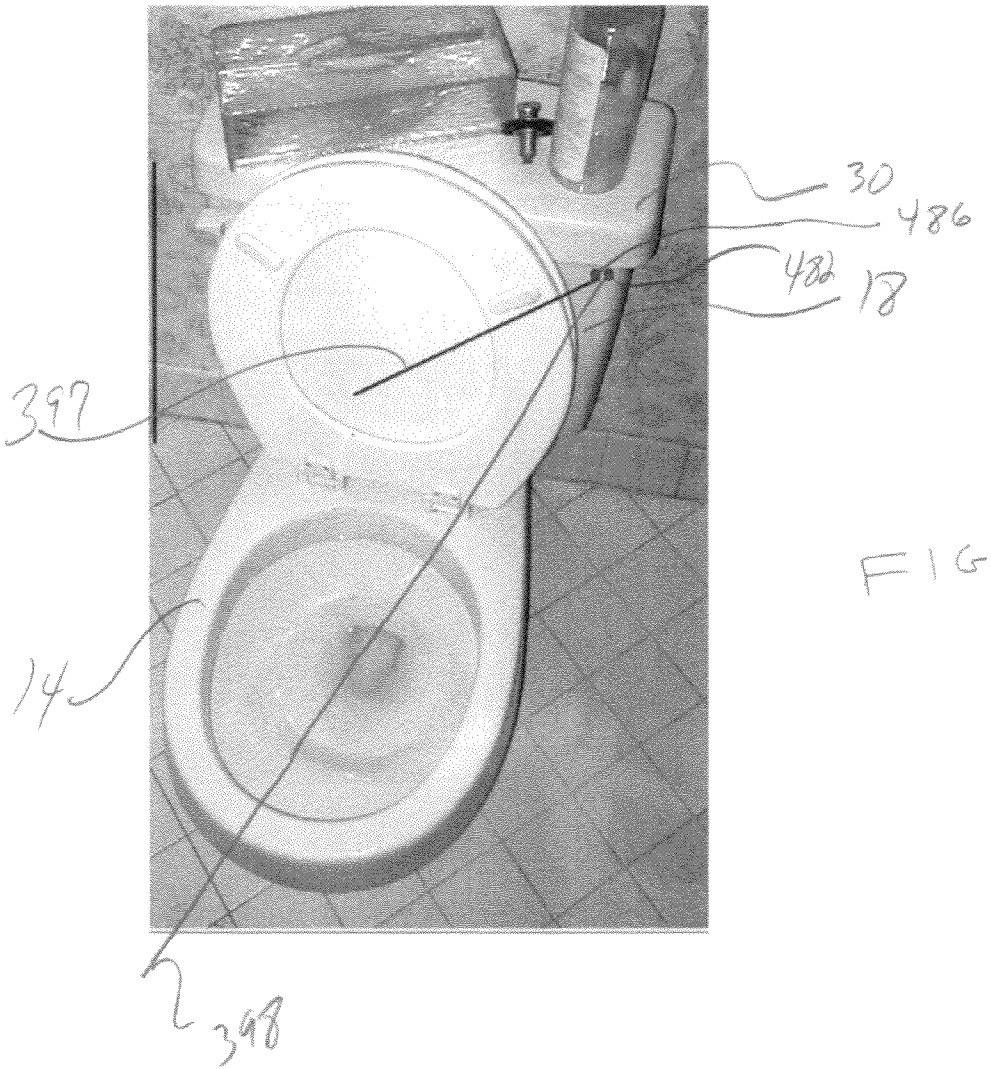
FIG. 27 is a front view of the another embodiment of the disclosed automatic control and battery power supply.

FIG. 27 shows a perspective view of a toilet tank installed with an odor removal unit 120 and the automatic control and battery power supply 450. Both the odor removal unit 120 and automatic control and battery power supply 450 are inside the tank 18 and not visible. However there is an opening or window 482 located in the tank 18 for the sensor 336 to be able to detect a person on the toilet. Similarly there is an opening or window 486 for the display lights to be in visual communication with the exterior of the tank 18.

The disclosed automatic control and battery power supply has many advantages. It is an autonomous unit, separate from the fan/filter unit. It is configured to be easily reprogrammed to provide customized, automated operation of any suitable device such as a closet light or a portable laptop computer alarm trigger, etc. It is located in an area, high up on the side of the toilet tank, that is generally expected to remain free of the contamination that is normally collected in the toilet bowl. The automation features can be used with either battery or building power. A key feature is a unique, PIC microcontroller controlled, direct current, voltage transformer/regulator. The, direct current, transformer function allows for production of a fan motor voltage that can be many multiples of the battery or external DC source supply voltage. In addition to providing precise and steady, adjustable fan speed control The regulator function allows for the fan motor voltage to remain virtually constant as the batteries age and their voltage steadily decreases. The primary advantage of this arrangement is to maintain steady fan performance as the batteries age and their voltage degrades. Since the fan voltage is relatively independent of the battery voltage the circuit is able to extract the maximum energy and service life from the batteries. This feature optimizes both economy and performance of the battery operation. It may have a sleep mode operation for the PIC and power supply, in which battery drain is extremely low. The invention would have an audible sounder and a visible LED warning that indicate when the batteries are low and will need to be replaced shortly. Note that the unit will still be capable of normal operation for a preset period of time after the low battery warning is issued. This allows time to obtain and replace the batteries prior to having a non-functional system with dead batteries.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. An automatic control and battery power supply system for a bathroom odor removal unit, the automatic control and battery power supply system comprising:

a toilet tank;

a housing, the housing comprising:

a top face in generally orthogonal communication with a toilet tank face;

the toilet tank face also in generally orthogonal communication with a bottom face;

an away face in generally orthogonal communication with the bottom face and top face;

a back face in generally orthogonal communication with the toilet tank face, top face and away face;

a front face in generally orthogonal communication with the toilet tank face, top face, and away face;

the bottom face in generally orthogonal communication with the back face; front face, toilet tank face, and away face;

a sensor face in communication with the front face, top face, bottom face, and toilet tank face, and wherein an angle between the sensor face and the toilet tank face is obtuse;

a hanger connected to the housing, and hanging from an upper edge of the toilet tank with the housing outside of and generally to one side of the toilet tank and located generally high up on the side of the toilet tank and away from the toilet bowl such that it will generally remain free of urine and feces;

a power supply located within the housing;

a controller located within the housing, and in communication with the power supply;

a sensor located on the sensor face, and in signal communication with the controller;

at least one display light located on the sensor face, and in signal communication with the controller;

a user input device located on the sensor face, and in signal communication with the controller;

a plug attached to the housing, and in signal communication with the controller.

2. The automatic control and battery power supply system of claim 1 wherein the sensor is a motion sensor.

3. The automatic control and battery power supply system of claim 1 wherein the sensor is a heat sensor.

4. The automatic control and battery power supply system of claim 1 wherein the sensor is an area reflective sensor.

5. The automatic control and battery power supply system of claim 1 wherein the user input device is a plurality of dip switches.

6. The automatic control and battery power supply system of claim 5, wherein there are 8 dip switches.

7. The automatic control and battery power supply system of claim 1, further comprising:

a horizontal slot located in the toilet tank face, generally adjacent to the top face;

wherein the hanger further comprises:

a main member;

a top orthogonal member in generally orthogonal communication with the main member;

an inwardly curved member in communication with the top orthogonal member;

a grooved bottom orthogonal member in generally orthogonal communication with the main member, the grooved bottom orthogonal member having a plurality of grooves located on its top surface, and wherein each groove is at a different angle relative to the main member;

a protruding member extending from an interior surface of the top face, and configured to fit into any of the plurality of grooves, such that when the protruding member is fitted into any of the plurality of grooves, the hanger may support the weight of the housing, power supply, controller, sensor, at least one display light, and plug.

8. The automatic control and battery power supply system of claim 7, further comprising:

a first groove located in the grooved bottom orthogonal member, and wherein the first groove makes an angle of about 0° with respect to the main member;

a second groove located in the grooved bottom orthogonal member, and wherein the second groove makes an angle of about 10° with respect to the main member;

a third groove located in the grooved bottom orthogonal member, and wherein the third groove makes an angle of about 20° with respect to the main member; and a fourth groove located in the grooved bottom orthogonal member, and wherein the fourth groove makes an angle of about 30° with respect to the main member.

9. The automatic control and battery power system supply of claim 1, further comprising:

a plurality of protuberances located on an outer surface of the toilet tank face.

10. The automatic control and battery power supply system of claim 1, wherein the plurality of protuberances extend about 3/32 to about 1/8 of an inch from an outer surface of the toilet tank face.

11. A bathroom odor removal system comprising:

a toilet tank;

an odor removal unit installed in the tank, wherein the odor removal unit does not have a controller or a power supply located within the odor removal unit;

an automatic control and battery power supply in signal communication with the odor removal unit, and hanging from the side of the toilet tank, the automatic control and battery power supply comprising:

a housing, the housing comprising:

a top face in generally orthogonal communication with a toilet tank face;

a toilet tank face in generally orthogonal communication with a bottom face;

an away face in generally orthogonal communication with the bottom face and top face;

a back face in generally orthogonal communication with the toilet tank face, top face and away face;

a front face in generally orthogonal communication with the toilet tank face, top face, and away face;

a bottom face in generally orthogonal communication with the back face; front face, toilet tank face, and away face;

a sensor face in communication with the front face, top face, bottom face, and toilet tank face, and wherein an angle between the sensor face and the toilet tank face is obtuse;

a hanger attached to the housing, and hanging from an upper edge of a toilet tank with the housing outside of and generally to one side of the toilet tank, and the housing being located generally high up on the side of the toilet tank and away from the toilet bowl such that it will generally remain free of urine and feces;

a power supply located within the housing;

a controller located within the housing, and in communication with the power supply;

a sensor located on the sensor face, and in signal communication with the controller;

at least one display light located on the sensor face, and in signal communication with the controller;

a user input device located on the sensor face, and in signal communication with the controller;

a plug attached to the housing, and in signal communication with the controller and in signal communication with the odor removal unit.

* * * * *